US010859025B2

(12) United States Patent
Trzeciak et al.

(10) Patent No.: US 10,859,025 B2
(45) Date of Patent: Dec. 8, 2020

(54) SYSTEMS AND METHODS FOR OPERATING A LIFT PUMP

(71) Applicant: Ford Global Technologies, LLC, Dearborn, MI (US)

(72) Inventors: Justin Trzeciak, Riverview, MI (US); Joseph Norman Ulrey, St. Joseph, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 172 days.

(21) Appl. No.: 16/047,376

(22) Filed: Jul. 27, 2018

(65) Prior Publication Data

US 2018/0334981 A1 Nov. 22, 2018

Related U.S. Application Data

(63) Continuation of application No. 15/353,535, filed on Nov. 16, 2016, now Pat. No. 10,077,733.

(51) Int. Cl.

| | |
|---|---|
| ***F02D 41/30*** | (2006.01) |
| ***F02M 37/08*** | (2006.01) |
| ***F02D 41/14*** | (2006.01) |
| ***F02D 41/20*** | (2006.01) |
| ***F02M 69/46*** | (2006.01) |
| ***F02D 41/38*** | (2006.01) |
| ***F02M 63/02*** | (2006.01) |
| *F02D 41/22* | (2006.01) |

(52) U.S. Cl.

CPC ..... *F02D 41/3082* (2013.01); *F02D 41/3854* (2013.01); *F02M 37/08* (2013.01); *F02M 63/0225* (2013.01); *F02M 69/465* (2013.01); *F02D 41/221* (2013.01); *F02D 2041/1412* (2013.01); *F02D 2041/2051* (2013.01); *F02D 2200/0604* (2013.01)

(58) Field of Classification Search

CPC ..... F02M 37/08; F02D 41/3082; F02D 2041/2051; F02D 2200/0602; F02D 2200/0604

USPC ..... 123/446, 456, 497

See application file for complete search history.

(56) References Cited

U.S. PATENT DOCUMENTS

| | | | | |
|---|---|---|---|---|
| 5,237,975 | A | 8/1993 | Betki et al. | |
| 5,749,344 | A | 5/1998 | Yoshiume et al. | |
| 5,842,454 | A * | 12/1998 | Miwa | F02D 41/3082 123/497 |
| 7,007,676 | B1 | 3/2006 | Schuricht et al. | |
| 7,093,576 | B2 | 8/2006 | DeRaad | |
| 7,640,916 | B2 | 1/2010 | Ulrey et al. | |
| 8,061,329 | B2 * | 11/2011 | Pursifull | F02D 41/2496 123/446 |
| 8,707,932 | B1 | 4/2014 | Marin et al. | |

(Continued)

*Primary Examiner* — Jacob M Amick
*Assistant Examiner* — Michael A Kessler
(74) *Attorney, Agent, or Firm* — Geoffrey Brumbaugh; McCoy Russell LLP

(57) ABSTRACT

Methods and systems are provided for operating a lift pump of an engine fuel system. In one example, a method may comprise predicting when a fuel rail pressure will decrease below a threshold assuming that a lift pump remains off. The method may further comprise powering on the lift pump before the fuel rail pressure decreases below to the threshold to prevent fuel rail pressure from decreasing below the threshold.

18 Claims, 9 Drawing Sheets

(56) References Cited

U.S. PATENT DOCUMENTS

| | | | | |
|---|---|---|---|---|
| 9,303,583 | B2 | 4/2016 | Surnilla et al. | |
| 9,995,237 | B2 | 6/2018 | Trzeciak et al. | |
| 2009/0114191 | A1* | 5/2009 | Pursifull | F02D 41/2496 123/447 |
| 2009/0188472 | A1* | 7/2009 | Ulrey | F02D 33/003 123/495 |
| 2010/0280742 | A1 | 11/2010 | Gwidt et al. | |
| 2014/0174403 | A1* | 6/2014 | Akita | F02D 41/3082 123/446 |
| 2015/0159577 | A1* | 6/2015 | Akita | F02D 33/003 123/497 |
| 2016/0025030 | A1 | 1/2016 | Ulrey et al. | |
| 2016/0146146 | A1 | 5/2016 | Pursifull | |
| 2016/0153383 | A1 | 6/2016 | Ulrey et al. | |
| 2016/0153388 | A1 | 6/2016 | Sanborn et al. | |
| 2016/0177861 | A1 | 6/2016 | Ulrey et al. | |
| 2016/0333815 | A1 | 11/2016 | Ulrey et al. | |
| 2017/0342936 | A1* | 11/2017 | Pursifull | F02D 41/3845 |
| 2018/0135550 | A1* | 5/2018 | Trzeciak | F02D 41/3854 |
| 2018/0135551 | A1* | 5/2018 | Trzeciak | F02D 41/3082 |
| 2018/0148037 | A1* | 5/2018 | Pursifull | F02D 41/22 |
| 2018/0148038 | A1* | 5/2018 | Ulrey | B60W 50/0205 |
| 2019/0063359 | A1* | 2/2019 | Kuempel | F02D 41/3854 |
| 2019/0078529 | A1* | 3/2019 | Kuempel | F02D 41/3854 |

* cited by examiner

SYSTEMS AND METHODS FOR OPERATING A LIFT PUMP

CROSS REFERENCE TO RELATED APPLICATION

The present application is a continuation of U.S. patent application Ser. No. 15/353,535, entitled "SYSTEMS AND METHODS FOR OPERATING A LIFT PUMP," filed on Nov. 16, 2016. The entire contents of the above-referenced application are hereby incorporated by reference in its entirety for all purposes.

FIELD

The present description relates generally to methods and systems for operating a fuel lift pump.

BACKGROUND/SUMMARY

Engine fuel may be pumped out of a fuel tank by a lift pump. The lift pump propels fuel towards a fuel rail before being injected by fuel injectors. A check valve may be included between the lift pump and the fuel rail to maintain fuel rail pressure and prevent fuel in the fuel rail from flowing back towards the lift pump. Operation of the lift pump is typically feedback controlled by an engine controller based on outputs from a pressure sensor coupled in the fuel rail. The controller attempts to maintain the pressure in the fuel rail to a desired pressure by adjusting an amount of electrical power supplied to the lift pump based on a difference, or error, between the desired fuel pressure and a measured fuel pressure obtained from the pressure sensor.

Thus, the lift pump replaces fuel lost to injection in the fuel rail. As fuel injection rates decrease therefore, the fuel resupply demands of the fuel rail correspondingly decrease, and the controller reduces the electrical power supplied to the lift pump. Consequently, the energy demands of the lift pump may be substantially proportional to fuel injection rates. In some examples, such as during engine idle and/or deceleration fuel shut-off (DFSO), the amount of electrical power supplied to the lift pump may drop sufficiently low, such that it may be more energy efficient to operate the lift pump in a low fuel flow mode. In the low fuel flow mode, the lift pump is not continuously powered nor powered via a duty cycled voltage as it would be with pulse width modulation (PWM). Instead, the lift pump may remain off and then may only be powered on when needed. For example, U.S. Pat. No. 7,640,916 describes an approach where under low engine loads, the lift pump remains off, and is only powered on to refill an accumulator.

However, the inventors herein have recognized potential issues with such systems. As one example, there may be a delay between lift pump power adjustments and observed fuel rail pressure changes. That is, it may take an amount of time before changes in lift pump power are reflected in the fuel rail pressure (assuming a substantially constant fuel injection rate). For example, when powering on the lift pump, the lift pump will not begin to add pressure to the fuel rail until the pressure upstream of the check valve, positioned between the lift pump and the fuel rail, exceeds the pressure downstream of the check valve. Thus, when the lift pump is powered on, the lift pump may not immediately start adding pressure to the fuel rail. In such examples, if the lift pump is powered on when the fuel rail pressure decreases to a minimum threshold, the fuel rail pressure may continue to decrease below the minimum acceptable level while the lift pump builds pressure upstream of the check valve. Such lift pump delays, may therefore result in fuel rail pressure undershoots and/or overshoots, which may result in fueling errors that can lead to drivability and robustness issues.

As one example, the at least some of the issues described above may be at least partly addressed a method comprising maintaining a lift pump off that supplies fuel to a fuel rail, assuming that the lift pump is maintained off, predicting when a fuel rail pressure will decrease below a threshold based on fuel injection rates, and powering on the lift pump before the fuel rail pressure decreases below the threshold such that actual fuel rail pressures do not decrease below the threshold. By powering on the lift pump before the fuel rail pressure decreases below the threshold, fuel rail pressure undershoots may be reduced.

In another example, a method comprises predicting when a fuel rail pressure will decrease below a threshold, calculating a desired instance to power on a lift pump based on a lift pump delay period, where the desired instance precedes when the fuel rail pressure is predicted to decrease below the threshold, stepping up a voltage supplied to the lift pump from zero to a first level at the desired instance, and ramping up the voltage supplied to the lift pump from the first level after the desired instance.

In yet another example a system comprises a lift pump, a fuel line coupled to the lift pump and comprising a fuel rail, the fuel rail including one or more fuel injectors, the fuel line delivering fuel from the lift pump to the fuel injectors, a check valve positioned in the fuel line between the lift pump and the fuel rail for maintaining fuel pressure downstream of the check valve, between the check valve and the fuel injectors, and a controller in electrical communication with the lift pump, the controller including computer readable instructions stored in non-transitory memory for: while the lift pump is off, predicting a decay profile for the fuel pressure downstream of the check valve, determining an instance to power on the lift pump based on the decay profile and a delay period of the lift pump such that the fuel pressure downstream of the check valve does not decrease below a threshold, and powering on the lift pump at the determined instance, before the fuel pressure downstream of the check valve reaches the threshold.

In this way, fuel rail pressure undershoots may be reduced. Specifically, by predicting how long it will take a lift pump to begin adding pressure to a fuel rail and forecasting future fuel injection rates, lift pump activation can be scheduled to prevent the fuel rail pressure from decreasing to undesirably low levels. As such, the lift pump can be kept off, increasing fuel savings, and then can be powered on at the appropriate time to prevent losses in engine performance and torque delivery.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for operating a lift pump. The lift pump may be included in a fuel system of an engine system, such as the engine system shown in FIG. 1. As shown in the example fuel system of FIG. 2, the lift pump pumps fuel from a fuel tank where the fuel is stored, to one or more fuel rails where the fuel is injected by fuel injectors. In some examples, the fuel system may be a direct injection (DI) system and fuel may be injected directly into one or more engine cylinders from a direct injection fuel rail. In such examples, a direct injection pump may be positioned between the lift pump and the direct injection fuel rail to further pressurize the fuel prior to injection into the one or more engine cylinders. However, in other examples, the fuel system may be a port fuel injection (PFI) system, and fuel may be injected into an intake port, upstream of the engine cylinders, by a port injection fuel rail. In such examples, fuel may be supplied directly to the port injection fuel rail by the lift pump. In still further examples, the fuel system may include both port fuel injection and direct injection, and as such may be referred to as port fuel direct injection (PFDI).

Figure 2:
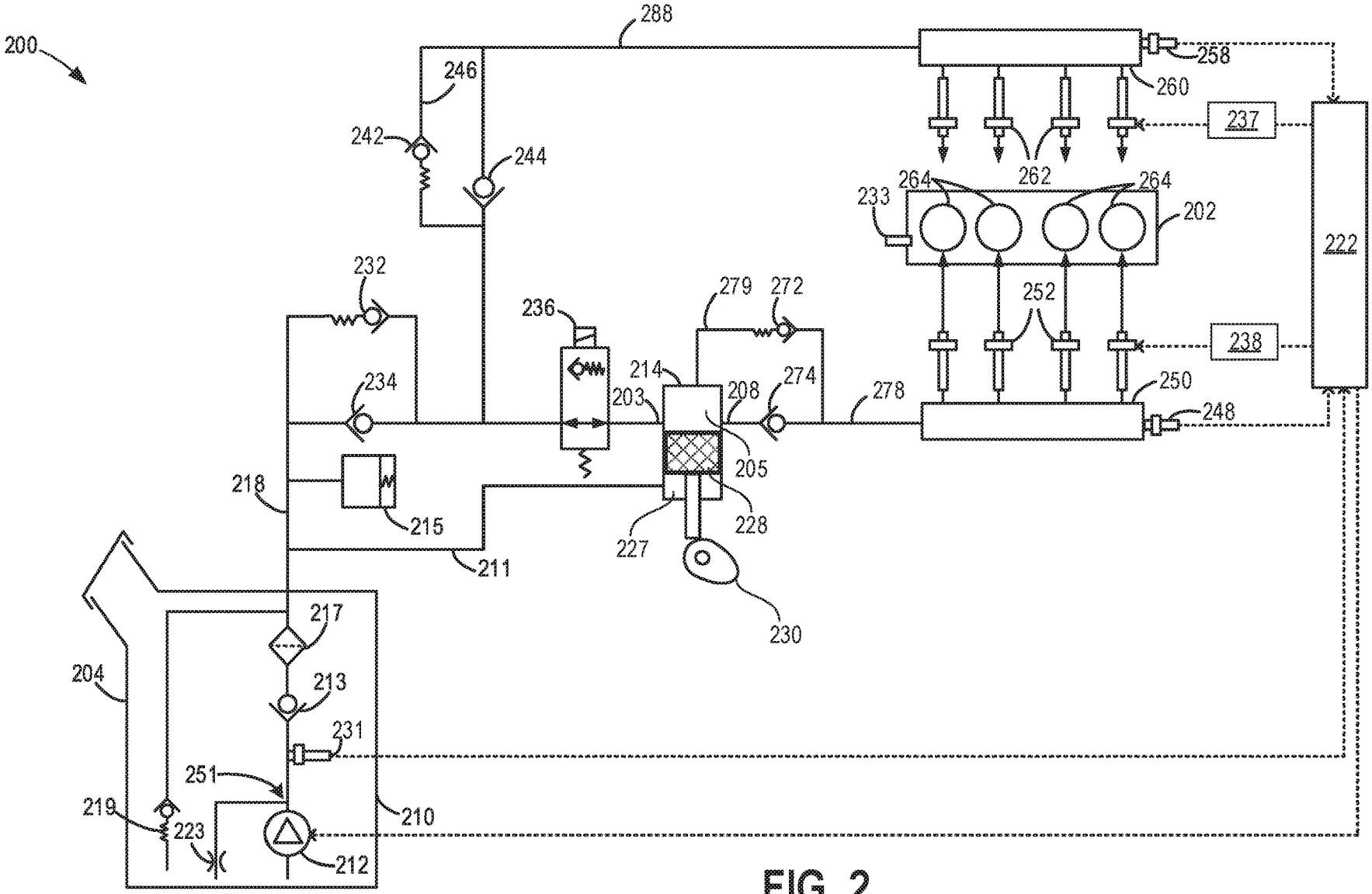
FIG. 2 shows a block diagram of an example fuel system that may be included in the engine system of FIG. 1, in accordance with an embodiment of the present disclosure.

Operation of the lift pump may be feedback controlled by an engine controller based on a fuel pressure at the fuel rail provided by a fuel rail pressure sensor, as is shown in the example fuel system of FIG. 2. The lift pump supplies fuel to the fuel rail, to replace fuel leaving the fuel rail via one or more fuel injectors. Thus, as fuel injection rates increase, more fuel may be pumped to the fuel rail to compensate for the increased loss of fuel from the fuel rail to injection. To increase the amount of fuel supplied to the fuel rail, power to the lift pump may be increased. Thus, power supplied to the lift pump may be approximately proportional to fuel injection rates.

However, the efficiency of the lift pump may decrease at lower power levels and/or fuel flow rates out of the pump. An example plot relating pump efficiency to fuel flow rates is shown in the graph of FIG. 3B. As such, the lift pump may be operated in different modes depending on engine operating conditions as described in the example method of FIG. 3A. For example, the lift pump may be operated in continuous first mode, as described in the example method of FIG. 4, when the efficiency of the pump increases above a threshold. When the efficiency of the pump decreases below the threshold, the lift pump may be operated in an intermittent second mode, as described in the example method of FIG. 5. In the intermittent second mode, the pump may remain off, and then may only be powered on when the fuel rail pressure is expected to decrease below a threshold. FIG. 6A shows an example method for determining how much power to supply to the lift pump when powering on the lift pump during the intermittent second mode.

It is important to note that the desired mode of operation of the lift pump may be selected based on one or more engine operating conditions such as: engine speed, fuel rail pressure, fuel injection rates, driver demanded torque, intake manifold pressure, boost pressure, etc. In the continuous first mode, the amount of power supplied to the lift pump may be closed loop feedback controlled based on the fuel rail pressure, where the fuel rail pressure is affected by the fuel injection rate. Thus, the power supplied to the lift pump may be affected by fuel injection rates, where the fuel injection rate may be determined based on one or more of driver demanded torque, intake manifold pressure, engine speed, throttle position, etc. Thus, the amount of power supplied to the lift pump may be directly and/or indirectly affected by the above mentioned engine operating conditions, since the fuel injection rates depend on the above mentioned engine operating conditions. Since the efficiency of the lift pump depends on the amount of power supplied to the pump (and therefore the fuel flow rate out of the pump), the determining which mode to operate the lift pump may also depend on one or more of the engine operating conditions mentioned above. The graph in FIG. 7 for example, shows how the lift pump may be operated in the different modes under varying engine operating conditions.

Regarding terminology used throughout this detailed description, a higher pressure pump, or direct injection fuel pump, may be abbreviated as a HP pump (alternatively, HPP) or a DI fuel pump respectively. As such, DI fuel pump may also be termed DI pump. Accordingly, HPP and DI fuel pump may be used interchangeably to refer to the higher pressure direct injection fuel pump. Similarly, the lift pump may also be referred to as a lower pressure pump. Further, the lower pressure pump may be abbreviated as LP pump or LPP. Port fuel injection may be abbreviated as PFI while direct injection may be abbreviated as DI. Additionally, fuel systems including both port fuel injection and direct injection may be referred to herein as port fuel direct injection and may be abbreviated as PFDI. Also, fuel rail pressure, or the value of pressure of fuel within a fuel rail may be abbreviated as FRP. A direct injection fuel rail may also be referred to as a higher pressure fuel rail, which may be abbreviated as HP fuel rail. Further, a port fuel injection rail may also be referred as a lower pressure fuel rail, which may be abbreviated as LP fuel rail.

It will be appreciated that in the example port fuel direct injection (PFDI) systems shown in the present disclosure, the direct injectors or the port injectors may be deleted without departing from the scope of this disclosure.

Figure 1:
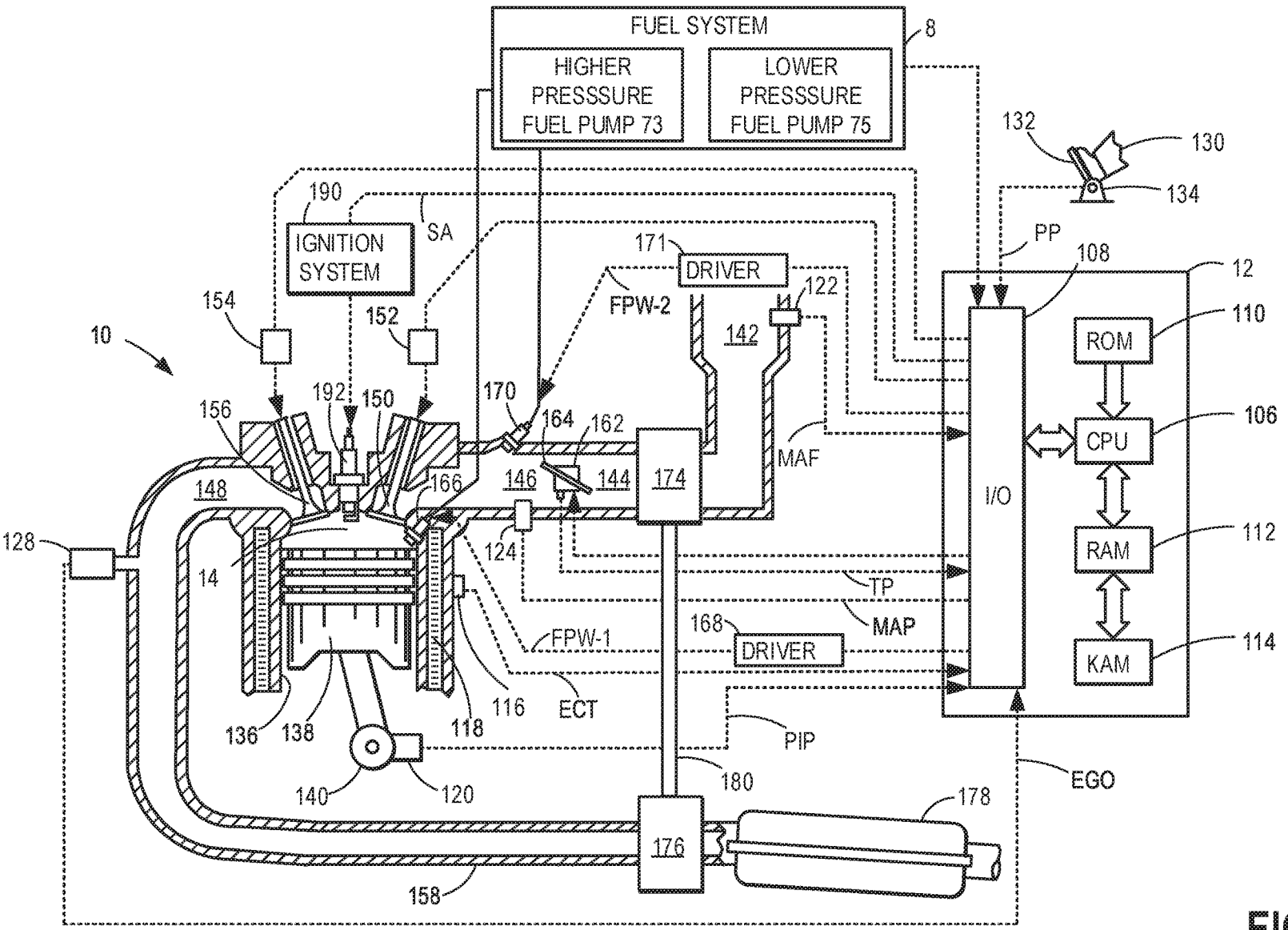
FIG. 1 shows a schematic diagram of an example engine system including a fuel system that may comprise one or more of direct injection and port injection, in accordance with an embodiment of the present disclosure.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. The dotted lines in FIG. 1 represent electrical connections between controller 12 and various engine sensors and actuators. Thus, components shown connected by a dotted line in FIG. 1 are electrically coupled to one another.

Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10. A position sensor, such as a Hall effect sensor 120 may be coupled to the crankshaft 140 for indicating a position of the crankshaft to controller 12. In particular, the controller 12 may estimate a position of the crankshaft (e.g., crank angle) based on outputs received from the Hall effect sensor 120.

Cylinder 14 can receive intake air via a series of intake air passages 142, 144, and 146. A mass airflow sensor 122 may be positioned in the intake, for example in air passage 142 as shown in FIG. 1, to provide an indication of an amount of air flowing to the cylinder 14. In particular, the controller 12 may estimate a mass airflow rate into cylinder 14 based on outputs received from mass airflow sensor 122. Intake air passages 142, 144, and 146 can communicate with other cylinders of engine 10 in addition to cylinder 14. In some examples, one or more of the intake air passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. In yet further examples, compressor 174 may be omitted. Thus, compressor 174 may increase the pressure of intake air received from intake passage 142 and delivered to intake passage 144. Thus air in intake passage 144 may be at a higher pressure than air in intake passage 142. Throttle 162 may then regulate an amount of boosted air delivered to intake passage 146 from intake passage 144. Intake passage 146 may also be referred to herein as intake manifold 146.

Throttle 162 including a throttle plate 164 may be arranged between intake air passages 144 and 146 of the engine for varying the flow rate and/or pressure of intake air provided to the engine cylinders. As shown in FIG. 1, throttle 162 may be positioned downstream of compressor 174, or alternatively may be provided upstream of compressor 174. The intake manifold 146 may include a pressure sensor 124 for indicating a manifold absolute pressure (MAP). Thus, the controller 12 may estimate an intake manifold pressure based on outputs received from the pressure sensor 124. The pressure sensor 124 may be positioned downstream of the compressor 174, and thus may also indicate a boost pressure provided by the compressor 174, in examples where compressor 174 is included in the engine 10.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake valve 150 and at least one exhaust valve 156 located at an upper region of cylinder 14. In some examples, each cylinder of engine 10, including cylinder 14, may include at least two intake valves and at least two exhaust valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom dead center position or top dead center position. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including first fuel injector 166. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into cylinder 14. Thus, first fuel injector 166, may also be referred to herein as DI fuel injector 166. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a higher pressure fuel pump 73, and a fuel rail. Further, the fuel tank may have a pressure transducer providing a signal to controller 12.

Additionally or alternatively, engine 10 may include second fuel injector 170. Fuel injector 166 and 170 may be configured to deliver fuel received from fuel system 8. Specifically, fuel may be delivered to fuel injector 170 from a fuel tank of fuel system 8 via a lower pressure fuel pump 75, and a fuel rail. As elaborated later in the detailed description, fuel system 8 may include one or more fuel tanks, fuel pumps, and fuel rails.

Fuel system 8 may include one fuel tank or multiple fuel tanks. In embodiments where fuel system 8 includes multiple fuel tanks, the fuel tanks may hold fuel with the same fuel qualities or may hold fuel with different fuel qualities, such as different fuel compositions. These differences may include different alcohol content, different octane, different heat of vaporizations, different fuel blends, and/or combinations thereof etc. In one example, fuels with different alcohol contents could include gasoline, ethanol, methanol, or alcohol blends such as E85 (which is approximately 85% ethanol and 15% gasoline) or M85 (which is approximately 85% methanol and 15% gasoline). Other alcohol containing fuels could be a mixture of alcohol and water, a mixture of alcohol, water and gasoline etc. In some examples, fuel system 8 may include a fuel tank holding a liquid fuel, such as gasoline, and also include a fuel tank holding a gaseous fuel, such as CNG.

Fuel injectors 166 and 170 may be configured to inject fuel from the same fuel tank, from different fuel tanks, from a plurality of the same fuel tanks, or from an overlapping set of fuel tanks. Fuel system 8 may include the lower pressure fuel pump 75 (such as a lift pump) and a higher pressure fuel pump 73. The lower pressure fuel pump 75 may be a lift pump that pumps fuel out of the one or more fuel tanks towards the one or more injectors 166 and 170. As detailed below with reference to the fuel system of FIG. 2, fuel provided to the first fuel injector 166 may be further pressurized by higher pressure fuel pump 73. Thus, the lower pressure fuel pump 75 may provide fuel directly to one or more of a port injection fuel rail and the higher pressure fuel pump 73, while higher pressure fuel pump 73 may deliver fuel to a direct injection fuel rail.

Fuel injector 170 is shown arranged in intake air passage 146, rather than in cylinder 14, in a configuration that provides what is known as port injection of fuel into the intake port upstream of cylinder 14. Second fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for optional fuel injector 170, may be used, as depicted.

In an alternate example, each of fuel injectors 166 and 170 may be configured as direct fuel injectors for injecting fuel directly into cylinder 14. In another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. In still another example, cylinder 14 may be fueled solely by optional fuel injector 170, or solely by port injection (also termed, intake manifold injection). As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among fuel injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor 124 may be used to provide an indication of vacuum, or pressure, in the intake manifold.

The controller 12 receives signals from the various sensors of FIG. 1 and employs the various actuators of FIG. 1 (e.g., throttle 162, fuel injector 166, fuel injector 170, higher pressure fuel pump 73, lower pressure fuel pump 75 etc.) to adjust engine operation based on the received signals and instructions stored on a memory of the controller. Specifically, the controller 12 may adjusting operation of the lower pressure fuel pump 75 based on a desired fuel injection amount and/or a pressure of a fuel rail as described in greater detail below with reference to FIG. 2.

FIG. 2 schematically depicts an example embodiment of a fuel system 200, which may be the same or similar to fuel system 8 of FIG. 1. Thus, fuel system 200 may be operated to deliver fuel to an engine, such as engine 10 of FIG. 1. Fuel system 200 may be operated by a controller 222, which may be the same or similar to controller 12 described above with reference to FIG. 1, to perform some or all of the operations described below with reference to the flow charts of FIGS. 3A and 4-7.

Fuel system 200 includes a fuel tank 210, a lift pump 212, a check valve 213, one or more fuel rails, a low pressure passage 218 providing fluidic communication between the pump 212 and the one or more fuel rails, fuel injectors, one or more fuel rail pressure sensors, and engine block 202. Lift pump 212 may also be referred to herein as lower pressure pump (LPP) 212.

As depicted in the example of FIG. 2, the fuel system 200 may be configured as a port fuel direction injection (PFDI) system that includes both a direct injection (DI) fuel rail 250, and a port fuel injection (PFI) fuel rail 260. However, in other examples, the fuel system 200 may be configured as a PFI system and may not include the DI fuel rail 250. Lift pump 212 may be operated by the controller 222 to pump fuel from the fuel tank 210 towards one or more of the DI fuel rail 250 and PFI fuel rail 260 via the low pressure passage 218. In particular, the controller 222 is in electrical communication with lift pump 212 via a wired or wireless connection, and send signals to the lift pump 212 to adjust operation of the lift pump 212. In particular, the controller 222 adjusts an amount of electrical power (e.g., voltage) supplied to the lift pump 212. By adjusting the amount of electrical power supplied to the lift pump 212, the controller 222 may thereby regulate an amount of fuel pumped out of the lift pump 212 towards one or more of the fuel rails 250 and 260.

Check valve 213 may be positioned in the low pressure passage 218, more proximate the fuel pump 212 than the fuel rails 250 and 260, to facilitate fuel delivery and maintain fuel line pressure in passage 218. Specifically, in some examples, check valve 213 may be included in the fuel tank 210. However, in other examples, the check valve 213 may be positioned outside the fuel tank 210, between the fuel tank and the fuel rails 250 and 260. The check valve 213 may be included proximate an outlet 251 of the lift pump 212. As such, flow in the low pressure passage 218 may be unidirectional from the lift pump 212 towards the fuel rails 250 and 260. Said another way, the check valve 213 may prevent bidirectional fuel flow in passage 218 since fuel does not flow backwards through the check valve 213 towards the lift pump 212 and away from the fuel rails 250 and 260. Thus, fuel may only flow away from the lift pump 212 towards one or more of the fuel rails 250 and 260 in the fuel system 200. In the description of fuel system 200 herein, upstream flow therefore refers to fuel flow traveling from fuel rails 250, 260 towards LPP 212 while downstream flow refers to the nominal fuel flow direction from the LPP towards the HPP 214 and thereon to the fuel rails.

A first pressure sensor 231 may be included between the lift pump 212 and the check valve 213 for indicating a pressure in the low pressure passage 218 upstream of the check valve 213. The first pressure sensor 231 may be in electrical communication with the controller 222 via a wired or wireless connection, for communicating the pressure upstream of the check valve 231 to the controller 222. Thus, the controller 222 may estimate the pressure in the passage 218 upstream of the check valve 213 based on outputs received from the first pressure sensor 231.

In some examples, the controller 222 may perform closed-loop feedback control operation of the lift pump based only on outputs from the first pressure sensor 231. For example, the controller 222 may perform closed-loop feedback control operation of the lift pump based only on outputs from the first pressure sensor 231, when, during the intermittent second mode of operation, the controller powers the lift pump to bring the pressure in the passage 218 upstream of the check valve 213 to approximately the same pressure as downstream of the check valve 213. In particular, the controller 222 may supply a voltage to the lift pump that is sufficient to increase the pressure upstream of the check valve 213 to that of downstream of the check valve 213 when initially powering on the lift pump during the intermittent second mode.

However, in other examples, the controller 222 may perform closed-loop feedback control operation of the lift pump based only on outputs from one or more fuel rail pressure sensors 248 and 258. For example, the controller 222 may perform closed-loop feedback control operation of the lift pump based only on outputs from one or more of the fuel rail pressure sensors 248 and 258 during the continuous powering first mode. However, in yet further examples, the controller 222 may perform closed-loop feedback control operation of the lift pump based on outputs from both the first pressure sensor 231 and one or more of the fuel rail pressure sensors 248 and 258.

In still further examples, the controller may operate the lift pump open loop (not based on feedback from the pressure sensors). For example, the controller may adjust the voltage supplied to the lift pump to a predetermined level and/or for a predetermined duration when powering the lift pump (e.g., providing a nonzero voltage to the lift pump) during the intermittent second mode.

After being pumped out of the fuel tank 210 by the lift pump 212, fuel may flow along passage 218 to either the DI fuel rail 250, or the PFI fuel rail 260. Thus, passage 218 may branch into DI supply line 278 and port injection supply line 288, where DI supply line 278 provides fluidic communication with the DI fuel rail 250 and port injection supply line 288 provides fluidic communication with the PFI fuel rail 260. Before reaching the DI fuel rail 250 via the low pressure passage 218, fuel may be further pressurized by a DI pump 214. DI pump 214 may also be referred to in the description herein as higher pressure pump (HPP) 214. Pump 214 may increase the pressure of the fuel prior to direct injection into one or more engine cylinders 264 by direct injectors 252. Thus, fuel pressurized by DI pump 214, may flow through DI supply line 278 to the DI fuel rail 250, where it may await direct injection to the engine cylinders 264 via the direct injectors 252. Direct injectors 252 may be the same or similar to fuel injector 166 described above with reference to FIG. 1. Further, direct injectors 252 may also be referred to in the description herein as direct injectors 252. DI fuel rail 250 may include a first fuel rail pressure sensor 248 for providing an indication of the fuel pressure in the fuel rail 250. Thus, controller 222 may estimate and/or determine the fuel rail pressure (FRP) of the DI fuel rail 250 based on outputs received from the first fuel rail pressure sensor 248.

In some examples, fuel flowing to the PFI fuel rail 260 may not be further pressurized after being pumped out of the fuel tank 210 by the lift pump 212. However, in other examples, fuel flowing to the PFI fuel rail 260 may be further pressurized by DI pump 214 before reaching the PFI fuel rail 260. Thus, fuel may flow from the lift pump 212 to the PFI fuel rail 260, prior to injection into an intake port, upstream of the engine cylinders 264 via port injectors 262. Specifically, fuel may flow through the low pressure passage 218, and then on to port injection supply line 288 before reaching the PFI fuel rail 260. Port injectors 262 may be the same or similar to injector 170 described above with reference to FIG. 1. Further, port injectors 262 may also be referred to in the description herein as port injectors 262. PFI fuel rail 260 may include a second fuel rail pressure sensor 258 for providing an indication of the fuel pressure in the fuel rail 260. Thus, controller 222 may estimate and/or determine the FRP of the PFI fuel rail 260 based on outputs received from the second fuel rail pressure sensor 258.

Although depicted as a PFDI system in FIG. 2, it should be appreciated that fuel system 200 may also be configured as a DI system, or as a PFI system. When configured as a DI system, fuel system 200 may not include PFI fuel rail 260, port injectors 262, pressure sensor 258, and port injection supply line 288. Thus, in examples where the fuel system 200 is configured as a DI fuel system, substantially all fuel pumped from the fuel tank 210 by the lift pump 212 may flow to the DI pump 214, en route to the DI fuel rail 250. As such, the DI fuel rail 250 may receive approximately all of the fuel pumped from the fuel tank 210 by the lift pump 212.

Further, it should also be appreciated that in examples where the fuel system 200 is configured as a PFI system, DI pump 214, DI supply line 278, DI fuel rail 250, pressure sensor 248, and direct injectors 252 may not be included in the fuel system 200. Thus, in examples where the fuel system 200 is configures as a PFI system, substantially all fuel pumped from the fuel tank 210 by the lift pump 212 may flow to the PFI fuel rail 260. As such the PFI fuel rail 260 may receive approximately all of the fuel pumped from the fuel tank 210 by the lift pump 212.

Continuing with the description of the fuel system 200, fuel tank 210 stores the fuel on-board the vehicle. Fuel may be provided to fuel tank 210 via fuel filling passage 204. LPP 212 may be disposed at least partially within the fuel tank 210, and may be an electrically-powered fuel pump. LPP 212 may be operated by controller 222 (e.g., controller 12 of FIG. 1) to provide fuel to HPP 214 via low pressure passage 218. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller 222 may send signals to the lift pump 212, and/or to a power supply of the lift pump 212, to reduce the electrical power that is provided to lift pump 212. By reducing the electrical power provided to the lift pump 212, the volumetric flow rate and/or pressure increase across the lift pump may be reduced. Conversely, the volumetric flow rate and/or pressure increase across the lift pump may be increased by increasing electrical power provided to the lift pump 212.

As one example, the electrical power supplied to the lower pressure pump motor by the controller 222 can be obtained from an alternator or other energy storage device such as a vehicle battery on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

A filter 217 may be disposed downstream of the lift pump 212, and may remove small impurities contained in the fuel that could potentially damage fuel handling components. In some examples, the filter 217 may be positioned downstream of the check valve 213. However, in other examples, filter 217 may be positioned upstream of the check valve 213, between the fuel pump 212 and the check valve 213. Furthermore, a pressure relief valve 219 may be employed to limit the fuel pressure in low pressure passage 218 (e.g., the output from lift pump 212). Relief valve 219 may include a ball and spring mechanism that seats and seals at a specified pressure differential, for example.

Fuel lifted by LPP 212 may be supplied at a lower pressure into low pressure passage 218. From low pressure passage 218, fuel may flow to an inlet 203 of HPP 214. More specifically, in the example depicted in FIG. 2, supply line 288 may be coupled on a first end to downstream of check valve 234, proximate or at an outlet 203 of the DI pump 214, and on a second end to the PFI fuel rail 260 to provide fluidic communication there-between. As such, substantially all fuel pumped out of the tank 210 by the lift pump 212 may be further pressurized by HPP 214 before reaching either of the fuel rails 250 and 260. In such examples, HPP 214 may be operated to raise the pressure of fuel delivered to each of the fuel rails 250 and 260 above the lift pump pressure, where the DI fuel rail 250 coupled to the direct injectors 252 may operate with a variable high pressure while the PFI fuel rail 260 coupled to the port injectors 262, may operate with a fixed high pressure. Thus, high-pressure fuel pump 214 may be in communication with each of fuel rail 260 and fuel rail 250. As a result, high pressure port and direct injection may be enabled.

In such examples, supply line 288 may include valves 244 and 242. Valves 244 and 242 may work in conjunction to keep the PFI fuel rail 260 pressurized to a threshold pressure (e.g., 15 bar) during the compression stroke of piston 228 of DI pump 214. Pressure relief valve 242 may limit the pressure that can build in fuel rail 260 due to thermal expansion of fuel. In some examples, the pressure relief valve 242 may open and allow fuel to flow upstream from the fuel rail 260 towards the passage 218, when the pressure between the valve 242 and the PFI fuel rail 260 increases above a threshold (e.g., 15 bar).

Alternatively, fuel may flow directly from low pressure passage 218 to PFI fuel rail 260 without passing through and/or being pressurized by DI pump 214. In such examples, supply line 288 may be coupled directly to low pressure passage 218, upstream of check valve 234. That is, the supply line 288 may be coupled on one end to upstream of the check valve 234 and downstream of the check valve 213, and on the opposite end to the PFI fuel rail 260, for providing fluidic communication there-between. Thus, no additional pumping and/or pressurization of the fuel may occur between lift pump 212 and the PFI fuel rail 260. Thus, in some examples, DI pump 214 may only be in communication with DI fuel rail 250 and may only pressurize fuel supplied to the DI pump 214. Thus, although the PFI fuel rail 260 is depicted in FIG. 2, to be coupled to downstream of check valve 234 via supply line 288, the supply line 288 may alternatively be coupled to upstream of the check valve 234.

As such, PFI fuel rail 260 may be supplied fuel at a lower pressure than the DI fuel rail 250. Specifically, PFI fuel rail 260 may be supplied with fuel at a pressure approximately the same as the fuel pressure at an outlet of the lift pump 212.

The pressure of each of the fuel rails 250 and 260, may depend on the mass fuel flow rate into the rails 250 and 260 via supply lines 218 and 288, respectively, and the mass fuel flow rates out of the rails 250 and 260 via the injectors 248 and 258, respectively. For example, the fuel rail pressures may increase when the mass flow rate into the fuel rail is greater than the mass flow rate out of the fuel rail. Similarly, the pressure may decrease when the mass flow rate out of the fuel rail is greater than the mass flow rate in to the fuel rail. Thus, when the injectors are off, and fuel is not exiting the fuel rail, the fuel rail pressure may increase while the lift pump 212 is on and spinning, so long as the pressure at the outlet of the fuel pump is greater than the pressure in the fuel rail, and the fuel pump 212 is therefore pushing fuel into the fuel rail. While each of the DI fuel rail 250 and PFI fuel rail 260 are shown dispensing fuel to four fuel injectors of the respective injectors 252, 262, it will be appreciated that each fuel rail 250 and 260 may dispense fuel to any suitable number of fuel injectors. As one example, DI fuel rail 250 may dispense fuel to one fuel injector of first injectors 252 for each cylinder of the engine while PFI fuel rail 260 may dispense fuel to one fuel injector of second injectors 262 for each cylinder of the engine. Controller 222 can individually actuate each of the port injectors 262 via a port injection driver 237 and actuate each of the direct injectors 252 via a direct injection driver 238. The controller 222, drivers 237 and 238, and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

Controller 222 may be a proportional integral (PI) or proportional integral derivative (PID) controller. As described above, controller 222 may receive an indication of fuel rail pressure via one or more of the first and second fuel rail pressure sensors 248 and 258. Controller 222 may additionally receive an indication of fuel line pressure upstream of the check valve 213 from pressure sensor 231. More specifically, the controller 222 may estimate the fuel rail pressure in one or more of the DI fuel rail 250 based on outputs from the first fuel rail pressure sensor 248 and in the PFI fuel rail 260 based on outputs from the second fuel rail pressure sensor 258. Based on a difference between a desired fuel rail pressure, and the actual measured fuel rail pressure provided by the one or more of the pressure sensors 248 and 258, the controller 222, may calculate an error. Thus, the error may represent the current difference between the desired fuel rail pressure and the fuel rail pressure estimated based on outputs from the one or more pressure sensors 248 and 258. The error may be multiplied by a proportional gain factor ($K_p$) to obtain a proportional term. Further, the sum of the error over a duration may be multiplied by an integral gain factor ($K_i$) to obtain an integral term. In examples, where the controller 222 is configured as a PID controller, the controller may further calculate a derivative term based on the rate of change of the error and a derivative gain factor ($K_d$).

One or more of the proportional term, integral term, and derivative term may then be incorporated into an output signal (e.g., voltage) sent from the controller 222 to pump 212 and/or a power source providing power to the pump 212, to adjust an amount of power supplied to the pump 212. Specifically, a voltage and/or current supplied to the pump 212 may be adjusted by the controller 222 to match the fuel rail pressure to the desired fuel rail pressure based on one or more of the proportional, integral, and derivative terms. A driver (not shown) electronically coupled to controller 222 may be used to send a control signal to the lift pump 212, as required, to adjust the output (e.g., speed) of the lift pump 212. Thus, based on a difference between the estimated fuel rail pressure obtained from one or more of the pressure sensors 248 and 258 and the desired fuel rail pressure, the controller 222 may adjust an amount of electrical power supplied to the pump 212, to match the actual fuel rail pressure more closely to the desired fuel rail pressure. Generally, the controller 222 may therefore increase power supply to the pump 212 when the fuel rail pressure is less than desired, and may decrease power supply to the pump 212 when the fuel rail pressure is greater than desired. This control scheme, where the controller 222 adjusts its output based on input received from one or more of the pressure sensors 248 and 258 may be referred to herein as closed loop, or feedback control. However, in some examples, as described below with reference to FIG. 4, the controller 222 may operate open loop under certain engine operating conditions.

During open loop control, the controller 222 may not adjust its output and/or the electrical power supplied to the pump 212 based on signals received from one or more of the pressure sensors 231, 248, and 258. Thus, during open loop control, the controller 222 may adjust operation of pump 212 based on the desired fuel rail pressure only. Specifically, the controller 222 may stop updating or freeze the integral term during open loop control. Thus, the controller 222 may not calculate an integral term during open loop control.

In another example, the controller 222 may operate the lift pump 212 in an intermittent mode, where the lift pump 212 is powered off, such that the controller 222 supplies substantially no (e.g., 0) electrical power to the lift pump 212 while the fuel rail pressure remains above a threshold, and only powers on the lift pump 212 when the fuel rail pressure is expected to decrease below the threshold over a future horizon or in response to the fuel rail pressure decreasing below the threshold. The lift pump may be powered on for a short duration to prevent the fuel rail pressure from decreasing below the threshold, and then may be powered off again, and may remain off until a fuel rail pressure increase is required. The example methods described below in FIGS. 3A and 4-7 provide more details on example operation of the lift pump 212 in the intermittent mode.

HPP 214 may be an engine-driven, positive-displacement pump. As one non-limiting example, HPP 214 may be a BOSCH HDPS HIGH PRESSURE PUMP. The HPP 214 may utilize a solenoid activated control valve (e.g., fuel volume regulator, magnetic solenoid valve, etc.) 236 to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

Continuing with the description of fuel system 200, it may optionally further include accumulator 215. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. For example, accumulator 215 may be coupled in low pressure passage 218, as shown, or in a bypass passage 211 coupling low pressure passage 218 to the step-room 227 of HPP 214. The volume of accumulator 215 may be sized such that the engine can operate at idle conditions for a predetermined period of time between operating intervals of lower pressure fuel pump 212. In other embodiments, accumulator 215 may inherently exist in the compliance of fuel filter 217 and low pressure passage 218, and thus may not exist as a distinct element.

An engine speed sensor 233 can be used to provide an indication of engine speed to the controller 222. The indication of engine speed can be used to identify the speed of higher pressure fuel pump 214, since the pump 214 may be mechanically driven by the engine 202, for example, via the crankshaft or camshaft.

DI fuel rail 250 is coupled to an outlet 208 of HPP 214 along DI supply line 278. In comparison, PFI fuel rail 260 may be coupled to the inlet 203 of HPP 214 via port injection supply line 288 in examples, where the HPP 214 is configured to pressurize fuel supplied to the PFI fuel rail 260. In other examples, PFI fuel rail 260 may not be coupled to the inlet 203 of the HPP 214 and may instead be coupled directly to the passage 218, upstream of check valve 234. A check valve 274 and/or a pressure relief valve 272 may be positioned between the outlet 208 of the HPP 214 and the DI fuel rail 250. Pressure relief valve 272 may be arranged parallel to check valve 274 in bypass passage 279 and may limit the pressure in DI supply line 278, located downstream of HPP 214 and upstream of DI fuel rail 250. For example, pressure relief valve 272 may limit the pressure in DI supply line 278 to an upper threshold pressure (e.g., 200 bar). As such, pressure relief valve 272 may limit the pressure that would otherwise be generated in DI supply line 278 if control valve 236 were (intentionally or unintentionally) open and while high pressure fuel pump 214 were pumping.

One or more check valves and pressure relief valves may also be coupled to low pressure passage 218, downstream of LPP 212 and upstream of HPP 214. For example, check valve 234 may be provided in low pressure passage 218 to reduce or prevent back-flow of fuel from high pressure pump 214 to low pressure pump 212 and fuel tank 210. In addition, pressure relief valve 232 may be provided in a bypass passage, positioned parallel to check valve 234. Pressure relief valve 232 may limit the pressure downstream of the check valve 234 to a threshold amount (e.g., 10 bar) higher than the pressure upstream of the check valve 234. Said another way, pressure relief valve 232 may allow fuel flow upstream, around the check valve 234, and towards LPP 212 when pressure the pressure increase across the relief valve 232 is greater than the threshold (e.g., 10 bar).

Controller 222 may be configured to regulate fuel flow into HPP 214 through control valve 236 by energizing or de-energizing the control valve 236 (based on the solenoid valve configuration) in synchronism with the driving cam. Accordingly, the solenoid activated control valve 236 may be operated in a first mode where the valve 236 is positioned within HPP inlet 203 to limit (e.g., inhibit) the amount of fuel traveling through the solenoid activated control valve 236. Depending on the timing of the solenoid valve actuation, the volume transferred to the fuel rail 250 may be varied. The control valve 236 may also be operated in a second mode where the solenoid activated control valve 236 is effectively disabled and fuel can travel upstream and downstream of the valve, and in and out of HPP 214.

As such, solenoid activated control valve 236 may be configured to regulate the mass (or volume) of fuel compressed into the DI pump 214. In one example, controller 222 may adjust a closing timing of the solenoid pressure control check valve to regulate the mass of fuel compressed. For example, a late pressure control valve closing may reduce the amount of fuel mass ingested into compression chamber 205. The solenoid activated check valve opening and closing timings may be coordinated with respect to stroke timings of the direct injection fuel pump.

Piston 228 may reciprocate up and down. HPP 214 is in a compression stroke when piston 228 is traveling in a direction that reduces the volume of compression chamber 205. HPP 214 is in a suction stroke when piston 228 is traveling in a direction that increases the volume of compression chamber 205.

Controller 222 may also control the operation of DI pump 214 to adjust an amount, pressure, flow rate, etc., of a fuel delivered to the DI fuel rail 250. As one example, controller 222 can vary a pressure setting, a pump stroke amount, a pump duty cycle command, and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed) of the low pressure pump. In some examples, the solenoid valve may be configured such that high pressure fuel pump 214 delivers fuel only to DI fuel rail 250, and in such a configuration, PFI fuel rail 260 may be supplied fuel at the lower outlet pressure of lift pump 212.

Controller 222 may control the operation of each of the injectors 252 and 262. For example, controller 222 may control the distribution and/or relative amount of fuel delivered from each injector, which may vary with operating conditions, such as engine load, intake manifold pressure, intake mass airflow rates, knock, and exhaust temperature. Specifically, controller 222 may adjust a direct injection fuel ratio by sending appropriate signals to port fuel injection driver 237 and direct injection 238, which may in turn actuate the respective port fuel injectors 262 and direct injectors 252 with desired pulse-widths for achieving the desired injection ratios. Additionally, controller 222 may selectively enable and disable (i.e., activate or deactivate) one or more of the injectors 252 and 262 based on fuel pressure within each rail. An example control scheme of the controller 222 is shown below with reference to FIGS. 3A and 4-7.

Turning to FIGS. 3A and 4-7, they show flow charts of example methods for operating a fuel lift pump (e.g., lift pump 212 described above in FIG. 2). A controller, such as controller 12 described above in FIG. 1 and/or controller 222 described above in FIG. 2 may include instructions stored in non-transitory memory for executing the methods described in FIGS. 3A and 4-7. In particular, the controller may adjust operation of the lift pump (e.g., an amount of electrical power supplied to the lift pump). The lift pump may be powered in a continuous power first mode which may comprise a duty-cycled voltage, and an intermittent power second mode where the pump may be powered off and then periodically powered on to maintain the fuel rail pressure above a threshold. The lift pump may be switched to the continuous power first mode when it is more energetically favorable than the intermittent power second mode. For example, the operating the lift pump in the intermittent power second mode may consume less electrical energy than operating the lift pump in the continuous power first mode during low fuel flow rates. However, as the fuel injection amount increases, the frequency at which the pump is powered on may increase while operating in the intermittent power second mode. When the fuel injection amount is sufficiently high, switching the pump back and forth between on and off may actually consume more electrical energy than just leaving the pump on, as in the continuous power first mode. Thus, the controller may switch to operating the lift pump in the continuous power first mode when the fuel flow demands from the lift pump increase above a threshold.

Figure 3A:
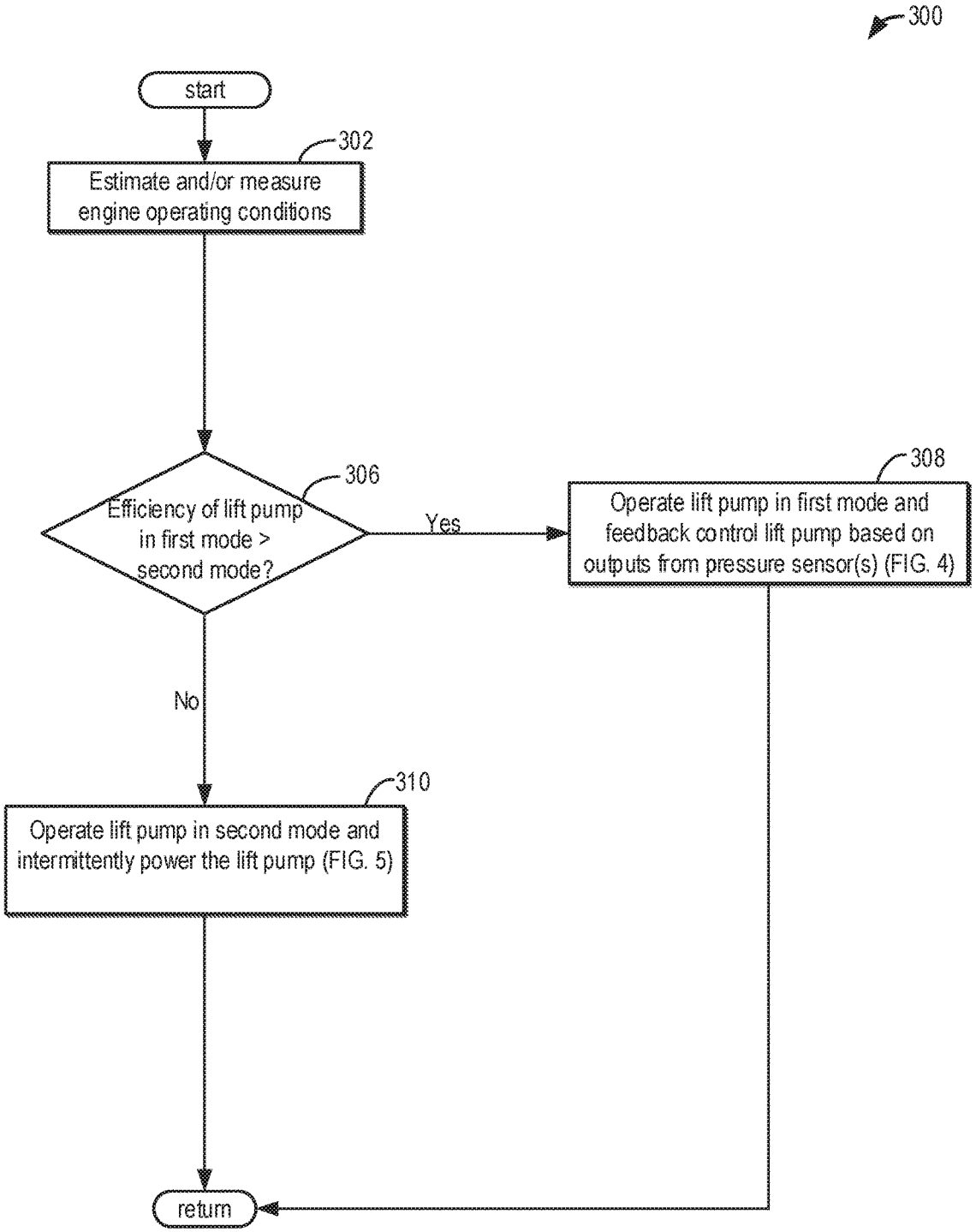
FIG. 3A shows a flow chart of a first example routine for operating a fuel lift pump, such as the lift pump of FIG. 2, in a continuous first mode and in an intermittent second mode, in accordance with an embodiment of the present disclosure.
Figure 3B:
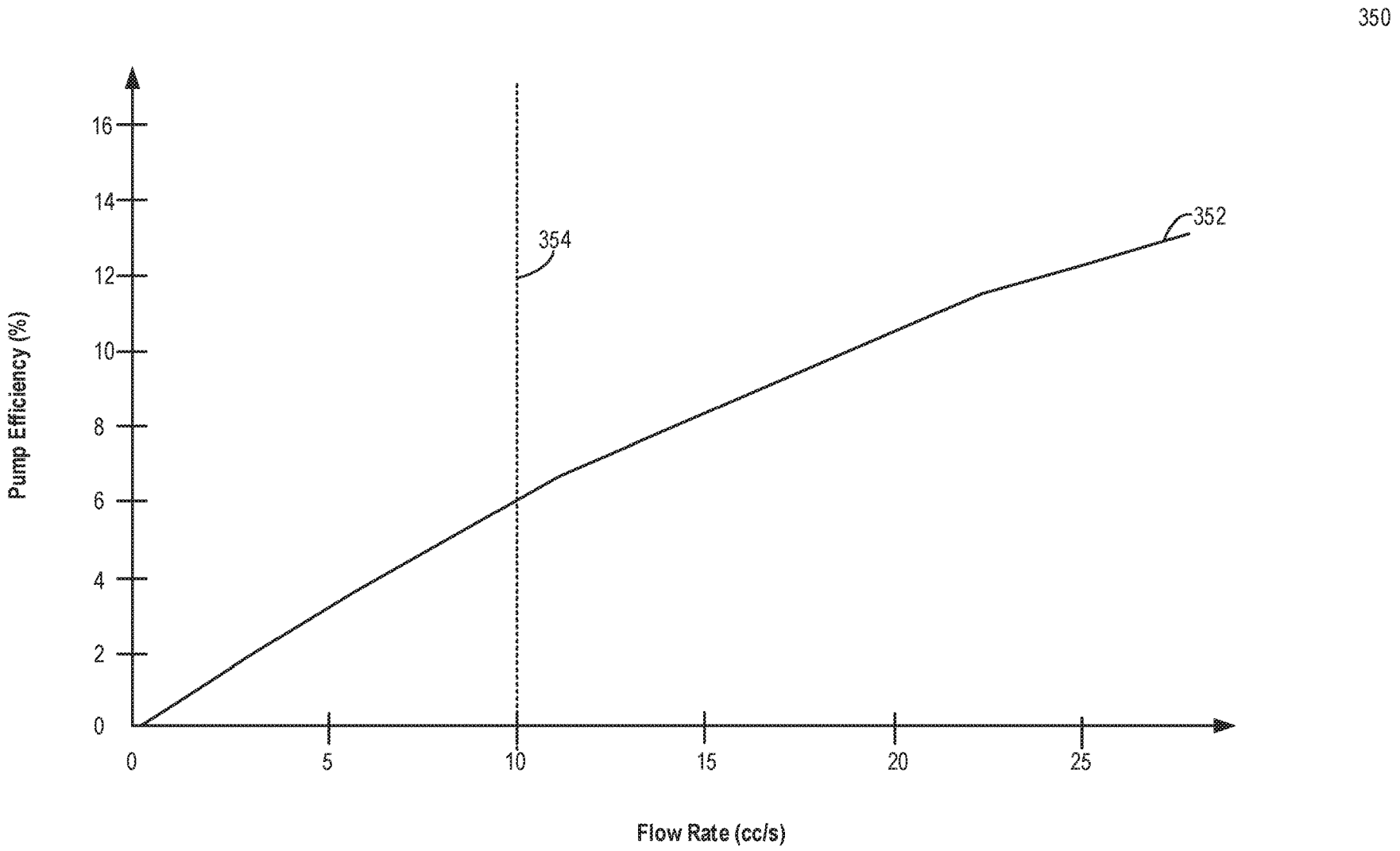
FIG. 3B shows a graph depicting example changes in the efficiency of a lift pump, such as the lift pump of FIG. 2, under varying fuel flow rates, in accordance with an embodiment of the present disclosure.

Focusing on FIG. 3A, it shows an example method 300 for determining when to operate the lift pump in the continuous power first mode, and when to operate the lift pump in the intermittent power second mode. Method 300 begins at 302 which comprises estimating and/or measuring engine operating conditions. Engine operating conditions may include one or more of engine speed, intake manifold pressure, fuel injection amount, fuel rail pressure, driver demanded torque, throttle position, crank angle, etc. The controller may receive a plurality of outputs from various engine sensors and the controller may estimate engine operating conditions based on the signals received from the sensors. For example, intake manifold pressure may be estimated based on outputs from a manifold absolute pressure sensor (e.g., pressure sensor 124 described above in FIG. 1), crank angle and/or engine speed may be estimated based on outputs from a crankshaft position sensor (e.g., Hall effect sensor 120 described above in FIG. 1), fuel rail pressure may be estimated based on outputs from a fuel rail pressure sensor (e.g., second fuel rail pressure sensor 258 described above in FIG. 2), driver demanded torque may be estimated based on the position of an accelerator pedal (e.g., position of input device 132 described above in FIG. 1 as estimated based on outputs from pedal position sensor 134 described above in FIG. 1), and fuel injection may be estimated based on a commanded fuel injection amount.

The commanded fuel injection amount may be a pulse width modulated (PWM) signal sent to one or more fuel injectors (e.g., port fuel injectors 262 described above in FIG. 2) by the controller, encoding a desired fuel injection amount to be injected by the fuel injectors. The PWM signal sent to the one or more fuel injectors may be determined and generated by the controller based on one or more of intake manifold pressure, driver demanded torque, a desired air/fuel ratio, intake mass airflow, throttle position, boost pressure, fuel rail pressure, etc. Thus, based on a pressure difference across the injector orifice and a desired amount of fuel to be injected to achieve a desired air/fuel ratio, the controller may determine an amount and/or duration to open the injector to achieve the desired air fuel ratio.

Method 300 then continues from 302 to 306 which comprises determining whether it is more energy efficient to operate the lift pump in the continuous power first mode or the intermittent power second mode. Efficiency of the lift pump is herein defined as the ratio of hydraulic power provided by the pump to the electric power provided to the pump. It may be more energy efficient to operate the lift pump in the second mode at lower fuel injection rates, engine loads, engine speeds, etc., where the amount of electrical power that would be supplied to the lift pump if operated in the continuous power first mode (e.g., closed loop feedback control) is less than a threshold. Thus, when fuel flow demands are lower, such that closed loop feedback control would command for an amount of fuel to be pumped by the lift pump that is less than a threshold, it may be more energy efficient to operate the lift pump in the second mode.

For example, FIG. 3B, shows a graph 350 depicting an example relationship between fuel flow rates out of the lift pump and efficiency of the lift pump. Specifically, graph 350 shows a plot 352 relating fuel flow rates out of the lift pump, to the lift pump's energy efficiency. Fuel flow rates out of the lift pump are shown along the x-axis, and pump efficiency is shown along the y-axis. Example fuel flow rates are shown in units of cc/s. Example pump efficiencies are shown as a percentage. When fuel flow rates out of the lift pump decrease below threshold 354 (shown in FIG. 3B), the efficiency of the lift pump may be greater in the second mode than in the first mode. Although the threshold 354 is shown in the example of FIG. 3B to be approximately 10 cc/s, it should be appreciated that in other examples, the threshold 354 may be greater than or less than 10 cc/s. The threshold 354 may be determined during calibration and/or manufacturer testing and/or may be adjusted during engine operation based on engine operating conditions. Thus, the controller may operate the lift pump in the first mode when the fuel flow rate is greater than the threshold 354, and may switch to operating the lift pump in the second mode when the fuel flow rate is less than the threshold 354.

Returning to the method 300 of FIG. 3A at 306, since the fuel flow rates out of the lift pump may be directly proportional to the amount of electrical power supplied to the lift pump, as explained above in the description of FIG. 2, the efficiency of the lift pump may generally be proportional to the amount of electrical power supplied to the lift pump. That is, the efficiency of the lift pump may increase for increases in the amount of electrical power supplied to the lift pump, and vice versa.

The amount of electrical power supplied to the lift pump in the continuous power first mode is feedback controlled based on a difference between measured fuel rail pressure and a desired fuel rail pressure. This difference may increase as fuel injection rates increase, since the amount of fuel leaving the fuel rail increases. Thus, the amount of electrical power supplied to the lift pump in the continuous power first mode may be approximately proportional to fuel injection rates. Since the desired fuel injection rates are determined based on one or more engine operating conditions such as: intake mass airflow, throttle position, boost pressure, and engine speed, to maintain a desired air/fuel ratio, the amount of electrical power supplied to the lift pump may also depend on the one or more engine operating conditions that are used to calculate the desired fuel injection rates. For example, when the engine speed increases above a threshold, the desired fuel injection rate may increase sufficiently high such that the fuel flow rate out of the lift pump may increase above the threshold 354, and it may therefore become more energy efficient to operate the lift pump in the continuous power first mode.

Thus, the efficiency of the lift pump may depend on the one or more engine operating conditions. As such, the controller may determine whether it is more energy efficient to operate the lift pump in the first mode or the second mode based on one or more of the engine operating conditions. For example, the controller may determine that it is more efficient to operate in the second mode than the first mode when the engine speed is less than a speed threshold. In another example, the controller may determine that it is more efficient to operate in the second mode than the first mode when the commanded fuel injection amount is less than an injection threshold. In yet another example, the controller may determine that it is more efficient to operate in the second mode than the first mode when the driver demanded torque is less than a torque threshold. In yet another example, the controller may determine that it is more efficient to operate in the second mode than the first mode when the intake mass airflow is less than an airflow threshold. In yet further examples, the controller may determine that it is more efficient to operate in the second mode than the first mode based on any one or more combinations of commanded fuel injection amount, intake mass airflow, engine speed, driver demanded torque, fuel flow out of the pump, pump voltage, etc., with respect to their respective thresholds. Thus, the controller may determine that it is more efficient to operate the lift pump in the second mode than the first when a threshold number of the engine operating conditions have decreased below their respective thresholds.

In addition to estimating current lift pump efficiency based on current engine operating conditions, the method 300 at 306 may comprise predicting future lift pump efficiencies based on future engine operating conditions. Future engine operating conditions, such as future fuel injection amounts, engine loads, lift pump power, engine speeds, intake mass airflows, etc., may be estimated based on one or more of upcoming road information provided by GPS or other mapping software, driver habits, engine history, weather, traffic information, etc. The controller may only switch to operating the pump in the first mode from the second mode when it is predicted that the first mode will remain the more energy efficient mode of operation for at least a threshold upcoming duration. Future efficiencies of the lift pump may be estimated in the same or similar manner to that for current pump efficiency: by estimating based on future fuel injection rates and therefore fuel flow demands. Thus, by only switching to the first mode when it is predicted that the first mode will remain the more energy efficient mode of operation for at least the threshold upcoming duration, excessive switching between the first and second modes may be reduced. The lift pump may switch between ON and OFF when switching between the first and second modes, and thus, reducing switching between the first and second modes, reduces the frequency at which the pump may be powered ON and OFF, thereby reducing power consumption. If is it determined at 306 that operating the lift pump would be more efficient in the first mode than the second mode, method 300 may continue to 308 which comprises operating the lift pump in the first mode and feedback controlling the lift pump based on outputs from the fuel rail pressure sensor(s) as described in greater detail below with reference to FIG. 4. Thus, the method 300 at may comprise adjusting an amount of electrical power supplied to the lift pump based on a difference between a desired fuel rail pressure and a measured fuel rail pressure estimated based on outputs from the pressure sensor(s). The lift pump may be powered to keep the pressure upstream of the check valve to a threshold while the desired fuel rail pressure is less than the actual measured fuel rail pressure as described in greater detail below with reference to the method included in FIG. 4. Method 300 then returns.

However, it if is determined at 306, that operating the lift pump would be more efficient in the second mode than in the first mode, method 300 may continue to 310 which comprises operating the lift pump in the second mode and intermittently powering the lift pump as described in greater detail below with reference to FIG. 5. Thus, the method 300 at 310 may comprise maintaining the lift pump OFF, and only powering on the lift pump for substantially short durations to prevent the fuel rail pressure from decreasing below a threshold. Method 300 then returns.

Figure 4:
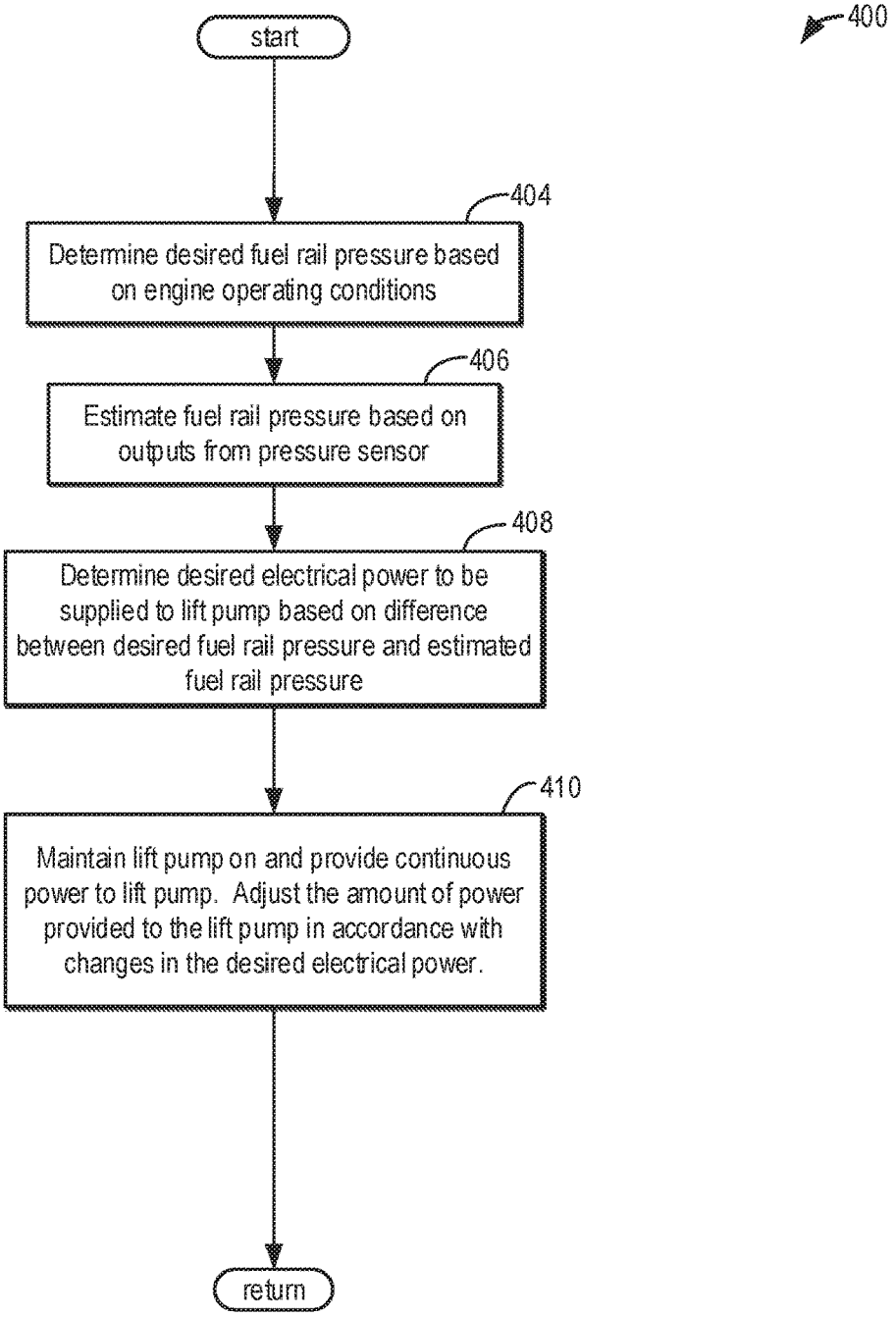
FIG. 4 shows a flow chart of a second example routine for operating a fuel lift pump, such as the lift pump of FIG. 2, in the continuous first mode, in accordance with an embodiment of the present disclosure.

Turning now to FIG. 4, it shows an example method 400 for operating the lift pump in the continuous power first mode. Thus, method 400 may be included as a subroutine of method 300 and may be executed at 308 of method 300, described above with reference to FIG. 3A. Method 400 may begin at 404 which comprises determining a desired fuel rail pressure based on engine operating conditions. For example, the desired fuel rail pressure may be determined based on an intake manifold pressure. In particular, the desired fuel rail pressure may increase for increases in the intake manifold pressure. The desired fuel rail pressure may additionally may be determined based on other engine operating conditions such as: fuel temperature, fuel vapor pressure, minimum fuel pulse width, fuel composition, fuel volatility, intake mass airflow, boost pressure, and future engine operating conditions. In other examples, the desired fuel rail pressure may be a pre-set, fixed pressure.

After determining the desired fuel rail pressure at 404, method 400 may continue to 406 which comprise measuring fuel rail pressure via the fuel rail pressure sensor. Thus, the controller may receive outputs from the pressure sensor, and may estimate the current fuel rail pressure based on the received outputs. This pressure may also be referred to herein as the measured fuel rail pressure.

The method 400 may then proceed from 406 to 408 which comprises determining a desired amount of electrical power to be supplied to the lift pump based on a difference between the desired fuel rail pressure and the estimated fuel rail pressure. As described above with reference to FIG. 2, the desired amount of electrical power to be supplied to the lift pump may be an output from a PI or PID controller. Thus, the method at 408 may comprise calculating one or more of a proportional, integral, and derivate term, and generating an output signal corresponding to an amount of electrical power to be supplied to the lift pump. Thus, generally, the amount of electrical power supplied to the lift pump may be proportional to the difference between the desired and estimated fuel rail pressures, such that when the estimated fuel rail pressure is less than the desired fuel rail pressure, the amount of electrical power supplied to the lift pump may increase for increases in the difference between the pressures and vice versa.

Thus, when the desired fuel rail pressure is less than the measured fuel rail pressure, the lift pump voltage may be reduced to zero, to stop the lift pump from adding pressure to the fuel rail. However, in some examples, when the desired fuel rail pressure is less than the measured fuel rail pressure, the lift pump voltage may be reduced to greater than zero. In particular the lift pump voltage may be reduced to a level which maintains the pressure upstream of the check valve to just below the desired fuel rail pressure. The controller may include a look-up table relating lift pump voltage to pressure upstream of the check valve. Thus, the controller may have a look-up table which dictates how much power to supply to the lift pump to achieve a desired pressure upstream of the check valve, assuming the check valve is not flowing fuel (e.g., the pressure downstream of the check valve is greater than the desired pressure upstream of the check valve). In other examples, the lift pump voltage may be reduced to a level (e.g., 5V) which maintains the pressure upstream of the check valve to just below a minimum threshold fuel rail pressure. In this way, when the measured fuel rail pressure decreases below the desired fuel rail pressure, due to injection, the lift pump may more immediately begin adding pressure to the fuel rail, thus increasing the responsiveness of the fuel system.

The electrical power (e.g., power, voltage, current) to be supplied to the lift pump may in some examples comprise a duty-cycled signal, where the duty cycle represents the percentage of the time that the voltage supplied to the lift pump is nonzero. Thus, the duty cycle may represent the percentage of one complete ON and OFF cycle that the signal is ON. Thus, the controller may adjust the amount of electrical power supplied to the lift pump by adjusting the duty cycle. Specifically, the controller may increase the amount of electrical power supplied to the lift pump by increasing the duty cycle of the signal. In some examples, the magnitude of the voltage supplied to the lift pump may be adjusted. For example, the controller may supply a continuous (e.g., 100% duty cycle) stream of electrical power to the lift pump, and may adjust the amount of electrical power supplied to the lift pump by adjusting the voltage level. In yet further examples, the controller may adjust both the voltage level and the duty cycle of the signal to adjust the amount of electrical power supplied to the lift pump.

Method 400 then continues from 408 to 410 which comprises maintaining the lift pump on and providing continuous power to the lift pump. In the description herein, continuous power may also be used to refer to and include duty cycled signals, since the duty cycled signals are effectively continuous streams of electrical power given the high frequency of their switching cycles. The method 400 at 410 may comprise continuing to adjust the amount of electrical power supplied to the lift pump in accordance with changes in the desired electrical power as determined based on the difference between the desired and measured fuel rail pressures. Method 400 then returns.

Figure 5:
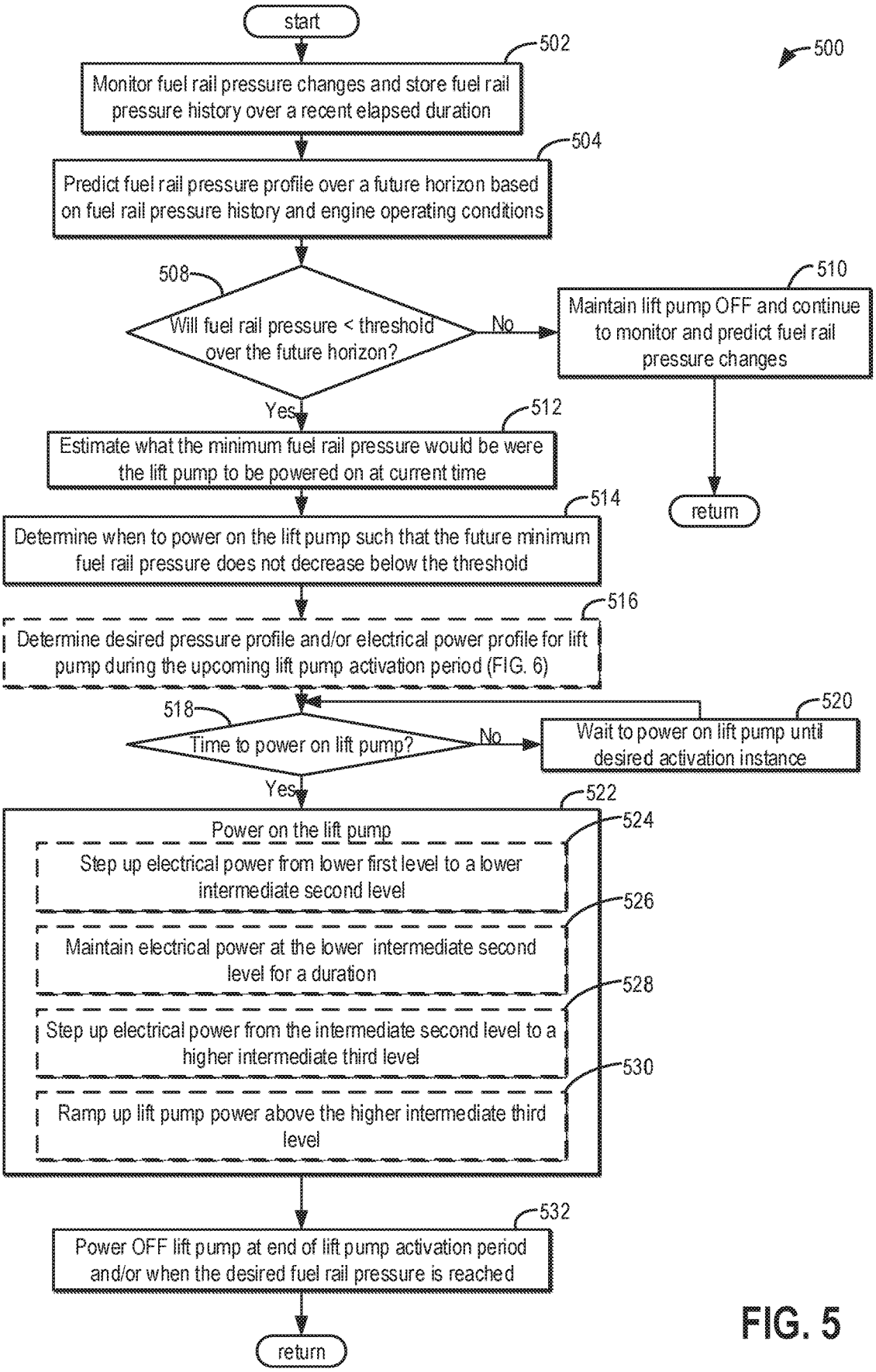
FIG. 5 shows a third example routine for operating a fuel lift pump, such as the lift pump of FIG. 2, in the intermittent second mode, in accordance with an embodiment of the present disclosure.
Figure 6A:
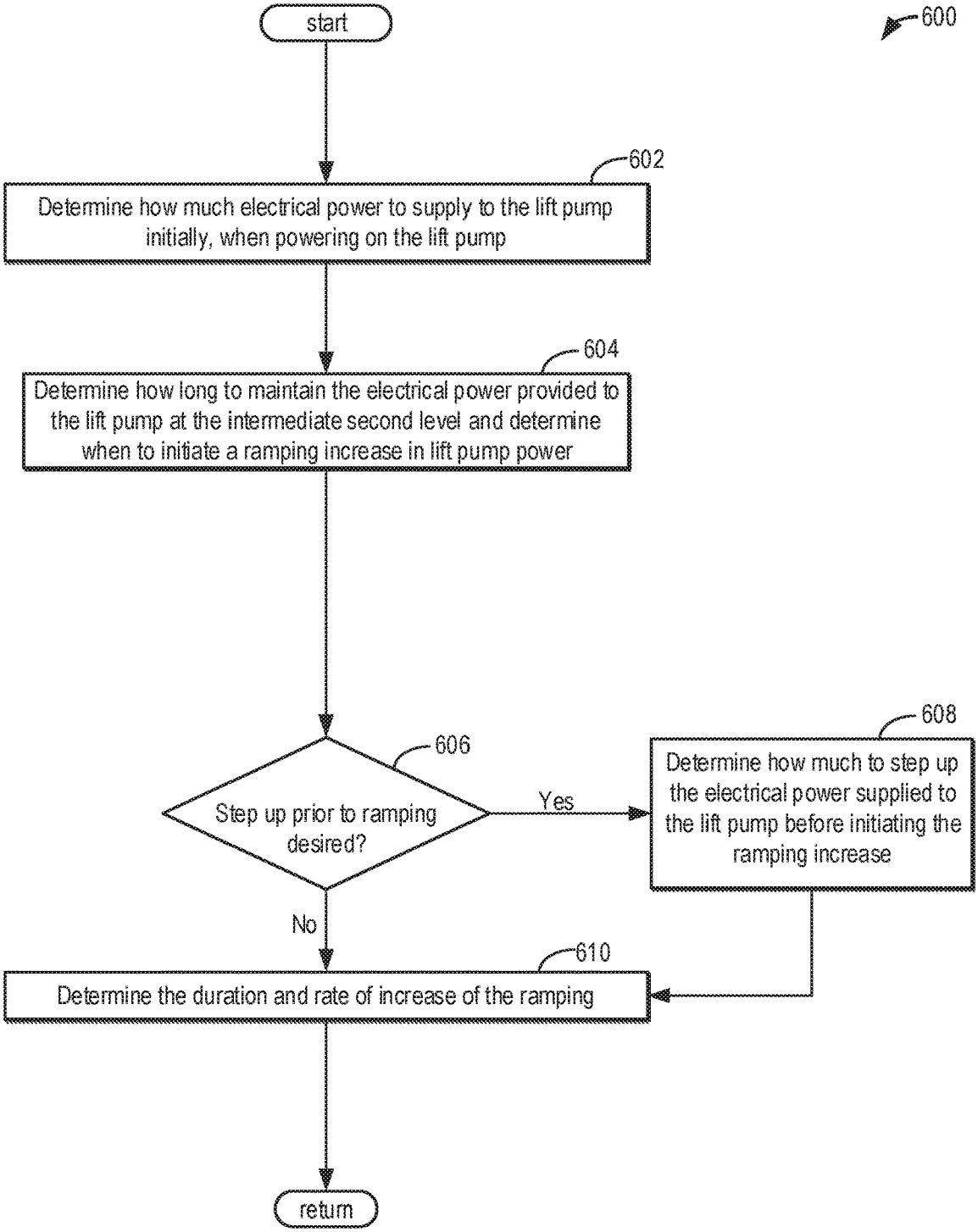
FIG. 6A shows a fourth example routine for determining how much power to supply to a lift pump, such as the lift pump of FIG. 2, when powering the lift pump during the intermittent second mode, in accordance with an embodiment of the present disclosure.

Continuing to FIG. 5, it shows a method 500 for operating the lift pump in the intermittent power second mode. Thus, method 500 may be included as a subroutine of method 300 and may be executed at 310 of method 300, described above with reference to FIG. 3A. Method 500 begins at 502 which comprises monitoring fuel rail pressure changes and storing the fuel rail pressure history over a recent elapsed duration. Thus, the method 500 at 502 may comprise storing in non-transitory memory, fuel rail pressure measurements from the fuel rail pressure sensor for a recent duration. The stored fuel rail pressure measurements may be referred to herein as the fuel rail pressure history.

Method 500 continues from 502 to 504 which comprises predicting a fuel rail pressure profile over a future horizon based on the fuel rail pressure history and engine operating conditions. Thus, based on the recent trend of fuel rail pressure measurements over the recent elapsed duration, and based on one or more of current and/or future predicted engine operating conditions, the controller may predict what the fuel rail pressure will be over the future horizon. The future horizon may comprise a duration extending from current time into future time. For example, while the lift pump remains off and does not pump fuel to the fuel rail, the fuel rail pressure may be predicted to decrease over the future horizon so long as fuel injection does not remain off, and some fuel leaves the fuel rail. Thus, the controller may predict the fuel rail pressure over a future horizon based on predicted fuel injection rates, which in turn may be predicted on future torque demands, engine speed, intake mass airflow rates, etc. As described above with reference to FIG. 3A, the future engine operating conditions may be estimated based on GPS or other navigational software, driver habits, upcoming road and traffic information, engine history, etc. In particular, the fuel rail pressure may decrease more rapidly at higher future predicted fuel injection rates, where the predicted fuel injection rates may increase for increases in one or more of the predicted torque demands, engine speeds, intake mass airflow rates, etc.

In some examples, at 504, the lift pump may be off, and it may be assumed that the pump will remain off over the future horizon. Thus, the calculation of the fuel rail pressure over the future horizon may be made assuming the pump will remain off and that no additional fuel will be pumped to the fuel rail. Thus, the calculation of the fuel rail pressure may be estimated based on the fuel injection rate and fluid compliance or stiffness. However, in other examples, the pump may not be off, and the controller may predict what the fuel rail pressure will be over the future horizon based on pump power, fuel injection, and fluid compliance or stiffness.

After predicting the future fuel rail pressure profile at 504, method 500 may then continue to 508 which comprises determining if the fuel rail pressure will decrease below a minimum pressure threshold over the future horizon. The minimum pressure threshold may be a pre-set threshold. For example, the minimum pressure threshold may represent a minimum acceptable fuel rail pressure, below which may lead to fuel metering errors during fuel injection. The threshold may be set based on avoidance of fuel vapor in the line, injector atomization, minimum pulsewidth, and DI pump volumetric efficiency. The method 500 comprises maintaining fuel rail pressure above the threshold during engine operation.

If the fuel rail pressure is not predicted to decrease below the minimum pressure threshold over the future horizon, then method 500 may continue from 508 to 510 which comprises maintaining the lift pump OFF and continuing to monitor and predict fuel rail pressure changes. Thus, the lift pump may remain OFF in the intermittent power second mode while the fuel rail pressure is predicted to remain above the minimum pressure threshold over the future horizon. Maintaining the lift pump OFF comprises not supplying electrical power to the lift pump. Thus, maintaining the lift pump OFF may comprise supplying zero voltage to the lift pump. Method 500 then returns.

However, if at 508 it is determined that the fuel rail pressure will decrease over the future horizon, then method 500 may continue from 508 to 512 which comprises estimating what the minimum fuel rail pressure would be were the lift pump to be powered on at the current time. Thus, if the controller were to power on the lift pump, the controller may estimate at 512, how much more the fuel rail pressure will decrease until the lift pump begins to add pressure to the fuel rail. When the lift pump is powered on, the pump may not immediately start adding pressure to the fuel rail. That is, there may be a delay between when the lift pump is powered on, and when the lift pump actually begins to add pressure to the fuel rail. During this delay, the fuel rail pressure may continue to decrease assuming some fuel is being injected by the injectors. The fuel rail pressure at which the pump begins adding pressure to the fuel rail comprises the minimum fuel rail pressure. The minimum fuel rail pressure may be calculated based on the fuel volume exiting the fuel rail (e.g., fuel injection rate), fuel compressibility, and a pump spin-up duration.

In particular, the fuel volume exiting the fuel line (e.g., passage 218 described above in FIG. 2) may be a fuel volume rate (e.g., cc/sec) of fuel exiting the fuel line to injection. For example, in a DI fuel system, the fuel volume exiting the line may be equal to fuel flow through the DI pump (pump 214 described above in FIG. 2) which may be a function of engine speed, DI pump command, and DI pump volume. In the example where the fuel system is configured as a PFI system, the fuel volume exiting the line may be equal to the fuel injection volume rate. In the example where the fuel system is configured as a PFDI system, the fuel volume exiting the line may be the sum of the above fuel flow through the DI pump and the fuel injection volume rate of the port injection fuel rail (e.g., fuel rail 260 described above in FIG. 2).

Fuel compressibility (e.g., fuel line stiffness) may be calculated by monitoring fuel rail pressure changes (e.g., via outputs from the fuel rail pressure sensor) while the lift pump remains off and determining an amount (e.g., mass or volume) of fuel injected by the fuel injectors (e.g., fuel injectors 262 described above in FIG. 2) of the fuel rail (e.g., fuel rail 260 described above in FIG. 2). In particular, the fuel compressibility may be calculated by dividing the change in fuel rail pressure over a duration by the amount of fuel injected by the fuel injectors during the duration ($\Delta P/\Delta V$, where $\Delta P$ represents the change in fuel rail pressure, and $\Delta V$ represents the total fuel volume injected during the duration). Thus, the fuel compressibility may be expressed in units of kPa/cc, for example. As such, the fuel stiffness is described by $\Delta P/\Delta V$, where the fuel stiffness increases for increases in the $\Delta P/\Delta V$. The amount of fuel injected during the duration may be estimated based on an amount of time the fuel injectors remain open to inject fuel, and a transfer function that relates injector opening durations to fuel injection amounts. In still further examples, the amount of fuel injected by the injectors may additionally be determined based on a pressure drop across the injector orifice which may be determined based on the fuel rail pressure estimated based on outputs from the fuel rail pressure sensor, and an intake manifold pressure, which may be estimated based on outputs from a MAP sensor (e.g., pressure sensor 124 described above in FIG. 1).

In some examples, the method 500 may additionally include detecting a faulty (e.g., stuck open), or leaking check valve when the fuel line stiffness increases above a threshold stiffness, and/or the fuel line stiffness increases by more than a threshold rate of increase. For example, when the check valve becomes stuck in an open position permitting fuel to flow backwards towards the lift pump, the fuel rail pressure may decrease substantially, due to fuel flowing backwards through the check valve. Thus, the change in pressure ($\Delta P$) may increase, resulting in an increase in the calculated fuel line stiffness. Thus, a leaky check valve may be detected when the calculated fuel line stiffness is greater than a threshold stiffness and/or when the fuel line stiffness increases by more than a threshold rate of increase.

The pump spin-up duration may be a duration extending from the instance the pump is powered on to the instance the pump meets current fuel line pressure. Pump spin-up duration may therefore comprise an amount of time measured in seconds for example. The current fuel line pressure may be a pressure downstream of a check valve (e.g., check valve 213 described above in FIG. 2) positioned between the lift pump and the one or more fuel rails. Pump spin-up duration may be determined by prior testing of the lift pump when the fuel line pressure is near the threshold. Thus, during lift pump testing, the fuel line pressure may be held proximate the pressure threshold described above at 508, and the pump may be powered on, and an amount of time it takes for the pump to begin adding pressure to the fuel line may be measured.

However, in other examples, the pump spin-up duration may be estimated based on an amount of electrical power to be supplied to the lift pump when initially powering on the lift pump to meet current fuel line pressure, and one or more of the current fuel line pressure, predicted injection flow rates, and predicted fuel line stiffness. For example, the pump spin-up duration may increase for decreases in the amount of electrical power to be supplied to the lift pump when initially powering on the lift pump, as it may take longer for the pump to reach the fuel line pressure when powered at lower voltages. As another example, the pump spin-up duration may increase for greater differences in the pressure upstream of the check valve to the pressure downstream of the check valve, as it may take longer for the pump to reach the fuel line pressure downstream of the check valve, when the pressure upstream of the check valve is less than the pressure downstream of the check valve at greater extents. As another example, the pump spin-up duration may increase if the fuel injection flow rates are predicted to decrease. If the fuel injection flow rates are predicted to decrease, the amount of fuel exiting the fuel line will be less, and thus, the fuel pressure downstream of the check valve will decrease at a lower rate, leading to the pressure downstream of the check valve to be higher than it would ordinarily be if fuel injection rates remained substantially constant. Thus, the pump spin-up time would be longer if the fuel injection rate is predicted to decrease than if the fuel injection rate is predicted to remain substantially constant.

The minimum fuel rail pressure may be calculated by multiplying the pump spin-up duration, fuel line stiffness, and fuel volume rate exiting the fuel line, and subtracting this resulting pressure from the current fuel rail pressure. Thus, multiplying the pump spin-up duration, fuel line stiffness, and fuel volume rate exiting the fuel line may provide a pressure that represents a change in fuel rail pressure (e.g., decrease or drop in pressure) that is predicted to occur during the pump spin-up duration. Subtracting the expected decrease in pressure from the current fuel rail pressure may provide the minimum future fuel rail pressure, where the minimum future fuel rail pressure is what the fuel rail pressure is expected to reach when the lift pump begins adding pressure to the fuel rail. As such, the expected pressure drop may increase for increases in one or more of the fuel injection rates (fuel volume rate exiting the fuel line), fuel line stiffness, and pump spin-up duration. Thus, the minimum future fuel rail pressure may decrease for increases in one or more of the fuel injection rates (fuel volume rate exiting the fuel line), fuel line stiffness, and pump spin-up duration.

Method 500 then continues from 512 to 514 which comprises determining when to power on the lift pump such that the future minimum fuel rail pressure calculated at 512 does not decrease below the threshold. The future minimum fuel rail pressure is the minimum fuel rail pressure that would be reached were the lift pump to be powered on at the current instance. That is, the future minimum fuel rail pressure is the fuel rail pressure at which the pressure downstream of the check valve would reach the pressure upstream of the check valve, were the lift pump to be powered on at the current instance. Thus, the future minimum fuel rail pressure is the pressure at which the lift pump would begin to add pressure to the fuel rail, were the lift pump to be powered on at the current time. In some examples, the future minimum fuel rail pressure may be approximately the same as the threshold pressure. For example, when powering on the lift pump during the intermittent power mode, the lift pump voltage may be set to a level which brings the pressure upstream of the check valve to the threshold pressure. As such, the fuel rail pressure may not decrease below the threshold because the pressure upstream of the check valve may be kept at or above the threshold pressure.

At 514, the lift pump may be off and the fuel rail pressure may be decreasing due to fuel leaving the fuel rail to injection. While the fuel rail pressure is decreasing and the lift pump is powered off in the intermittent power second mode, the lift pump may be powered back on before the fuel rail pressure reaches the threshold pressure, to prevent the fuel rail from decreasing below the threshold. Thus, the controller may continuously or periodically calculate what the minimum fuel rail pressure would be were the lift pump to be powered on at the current instance. When the minimum fuel rail pressure reaches, or is within a threshold range of the threshold pressure, then the controller may power on the lift pump to prevent the fuel rail pressure from decreasing below the threshold. Thus, it may be desired to power on the lift pump when powering on the lift pump at the current time would result in the minimum pressure being equal to, or within a threshold above, the threshold pressure. Thus, in response to the minimum fuel rail pressure reaching, or decreasing to within a threshold difference above the threshold pressure, the controller may power on the lift pump in the intermittent power second mode. In this way, undershoots in fuel rail pressure may be reduced, and thus fuel metering errors which may lead to reduced engine performance may be minimized.

In another example, the lift pump may be powered on a predetermined duration prior to the fuel rail pressure reaching the threshold. Thus, the controller may predict a first instance at which the fuel rail pressure is expected to reach the threshold, and may power on the lift pump at a second instance, the second instance being prior to the first instance, at a predetermined duration before the first instance. The predetermined duration may be sufficiently long before the first instance such that the pump can increase the pressure upstream of the check valve to match the pressure downstream of the check valve before the pressure downstream of the check valve decreases below the threshold.

Method 500 may then continue from 514 to optional step 516 which comprises determining a desired pressure profile and/or electrical power profile for the lift pump during the upcoming lift pump activation period, as described in greater detail below in the example method of FIG. 7. In particular, prior to, or when powering on the lift pump in response to determining at 514 that it is desired to power on the lift pump, the controller may determine how much power to supply to the lift pump, and/or how long to supply power to the lift pump. That is, a desired electrical power profile and/or fuel rail pressure profile may be determined, such that when powering on the lift pump in the intermittent power second mode, lift pump voltage may be either open loop controlled according to a predetermined voltage profile, or closed looped controlled according to a predetermined desired fuel rail pressure profile, or a combination of both open loop and closed loop controlled. The desired electrical power profile and/or desired fuel rail pressure profile may be pre-set profiles that are stored in non-transitory memory of the controller. However, in other examples, the desired electrical power profile and/or desired fuel rail pressure profile may be determined based on one or more current and/or future engine operating conditions such as fuel injection rates, fuel line stiffness, intake manifold pressure, engine speed, etc.

In some examples, the desired pressure profile and/or electrical power profile may be determined at or prior to powering on the lift pump in the second mode according to current engine operating and/or predicted engine operating conditions. However, in other examples, the desired pressure profile and/or electrical power profile may be adjusted based on engine operating conditions while the lift pump is powered on. That is, the controller may adjust one or more of the desired pressure profile and/or electrical power profile in real-time to account for deviations in engine operating conditions from what was predicted during the generation of the initial pressure and/or electrical power profiles.

Method 500 may then continue from 516 to 518 which comprises determining if it desired to power on the lift pump. As described above in 514 it may be desired to power on the lift pump when the fuel rail pressure reaches or decreases to the threshold pressure. If the current fuel rail pressure is still greater than the threshold pressure or greater than the threshold pressure, then the pump may be left off without experiencing a drop in fuel rail pressure below the threshold, and thus it may not be desired to power on the lift pump. If it is not yet time to power on the lift pump, then method 500 continues from 518 to 520 which comprises waiting to power on the lift pump until a desired activation instance. The desired activation instance may be a future time when the fuel rail pressure does reach the threshold pressure.

Thus, it should be emphasized that the future horizon over which the fuel rail pressure is predicted comprises a longer duration than the pump spin-up duration. If at some instance during the future horizon it is predicted that the fuel rail pressure will decrease below the threshold, then the controller begins calculating the minimum fuel rail pressure. As time progresses into the future horizon and draws nearer to the instance at which the fuel rail pressure is expected to reach the threshold, the minimum fuel rail pressure, which is what the fuel rail pressure will be at the end of the pump spin-up duration, continues to be calculated. However, the controller may begin calculating the minimum fuel rail pressure before the pump needs to be powered on to prevent the fuel rail pressure from decreasing below the threshold. Thus, the method 500 at 518 and 520 comprises continuing to perform the minimum fuel rail pressure calculation, and waiting to power on the lift pump until the minimum fuel rail pressure calculation reaches the pressure threshold or decreases to within a threshold of the threshold pressure.

When the desired activation instance is reached, and it is desired to power on the lift pump, method 500 may continue from 518 to 522 which comprises powering on the lift pump during an activation period. The activation period may comprise the duration during which the lift pump is powered on. That is, the activation period comprises a duration during the intermittent power second mode during which the lift pump is powered on and then powered off again. Thus, the activation period may comprise a single cycle during which the lift pump is powered on in the second mode. As described above with respect to 516, the electrical power profile, which comprises the amount and duration of the electrical power to be supplied to the lift pump over the activation period may be pre-set. It is important to note that the lift pump may be operated under open loop control when powering the lift pump at 522. In open loop control, the amount of electrical power supplied to the lift pump may be adjusted by adjusting the desired pressure. As explained above in FIG. 2, when in open loop control, the amount of electrical power supplied to the lift pump is adjusted based on the desired pressure and not on the difference between the desired pressure and measured pressures. Thus, the controller may include a look-up table, for example, that relates desired pressures to commanded lift pump voltages when operating in open loop control.

In some examples, the electrical power profile may be determined based on current and/or future engine operating conditions. In yet further examples, as described in FIG. 7, the electrical power profile and/or desired pressure profile may be adjusted during the activation period based on changes in engine operating conditions.

Specifically, the method 500 at 522 may comprise stepping up the electrical power from a lower first level (e.g., 0V) to a lower intermediate second level at 524. As explained above, the stepping up the electrical power may be achieved in open loop control by increasing the desired pressure. Since during open loop control, the commanded voltage supplied to the lift pump may depend only on the desired pressure (e.g., set point) and not on feedback from one or more pressure sensors, the electrical power supplied to the lift pump depends directly on the desired pressure. Specifically, the desired pressure may be stepped up to an intermediate second pressure level. The intermediate second pressure level may be substantially the same as the pressure downstream of the check valve. However, in other examples, the intermediate second pressure level may be greater or less than the pressure downstream of the check valve. In yet further examples, the intermediate second pressure level may be approximately the same as the minimum threshold pressure. In this way, the fuel pressure upstream of the check valve may be maintained at least at the minimum threshold pressure, to prevent the fuel rail pressure from decreasing below the minimum threshold pressure. Thus, once the fuel rail pressure reaches the minimum threshold pressure, fuel may begin flowing through the check valve, and the lift pump power may be increased to begin increasing the fuel rail pressure.

The stepping up the electrical power from the lower first level may comprise powering on the lift pump from OFF up to the lower intermediate second level. The lower intermediate second level is a voltage level less than a maximum voltage level of the lift pump. In one example, the lower intermediate second level may be approximately half of the maximum voltage level of the lift pump. However, in other examples, the lower intermediate second level may be more or less than half of the maximum voltage level of the lift pump.

However, in another example, the stepping up the electrical power to the lift pump may be achieved by closed-loop controlling the lift pump based on outputs from the pressure sensor positioned between the lift pump and the check valve. Thus, the controller may set the desired pressure to the intermediate second pressure level and may closed-loop control the lift pump based on the pressure outputs from the pressure sensor upstream of the check valve. In this way, the controller may increase the pressure upstream of the check valve to, or just below, the pressure downstream of the check valve. In this way, the lift pump may more quickly begin adding pressure to the fuel rail when desired.

In some examples, once the lift pump voltage and/or desired pressure has been stepped up to the lower intermediate second level, the controller may begin ramping up the lift pump voltage past a higher intermediate third level at 530. The ramping may be achieved by open-loop controlling the lift pump and simply increasing the desired pressure at a desired rate, or the ramping may be achieved by closed-loop controlling the lift pump based on outputs from the fuel rail pressure sensor, and increasing the desired fuel rail pressure by a specified amount or a specified rate when the measured fuel rail pressure reaches the desired fuel rail pressure. Thus, the ramping may be achieved by incrementally increasing the desired fuel rail pressure, where at each increase in the desired fuel rail pressure the controller waits to increase the desired fuel rail pressure again, until the lift pump has increased the fuel rail pressure to the current desired fuel rail pressure.

However, in other examples, the lift pump voltage may be held at the lower intermediate second level for a first duration at 526. In some examples, the first duration at 526 may be a preset duration. However, in other examples, the duration may be calculated based on the difference between the pressure upstream of the check valve and downstream of the check valve. In yet further examples, the duration may depend on the time it takes the lift pump to bring the pressure upstream of the check valve up to the pressure downstream of the check valve. Thus, the controller may maintain the lift pump voltage at the lower intermediate second level, until the pressure upstream of the check valve increases to within a threshold difference below the pressure downstream of the check valve, or until the pressure upstream of the check valve reaches and/or increases above the pressure downstream of the check valve.

Then, after the first duration, the lift pump voltage may either be stepped up from the intermediate second level to the higher intermediate third level at 528, or may be ramped up from the intermediate second level to above the higher intermediate third level at 530. Thus, in response, to the pressure upstream of the check valve reaching, or increasing to within a threshold difference of, the pressure downstream of the check valve, the controller may increase the lift pump voltage above the intermediate second level to begin adding pressure to the fuel line downstream of the check valve. The lift pump voltage may be stepped up from the intermediate second level to the higher intermediate third level at 528 in the same or similar manner to that described when stepping up the lift pump voltage to the intermediate lower second level at 524. Thus, the lift pump voltage may be stepped up by the controller via open-loop control, or may be increased by stepping up the desired fuel rail pressure from the intermediate second pressure level to a higher intermediate third pressure level, and closed-loop operating the lift pump based on outputs from the fuel rail pressure sensor.

In examples where the lift pump voltage is stepped up from the lower intermediate second level to the higher intermediate third level, the controller may then ramp up the lift pump voltage after stepping up the lift pump voltage to the higher intermediate third level. Thus, in some examples, the controller may execute 530 after executing 528. FIGS.

6A and 6B provide more detailed descriptions of example lift pump operation when powering on the lift pump during the intermittent power second mode.

When the activation period has terminated, method 500 may continue from 522 to 532 which comprises powering OFF the lift pump at the end of the activation period and/or when a desired fuel rail pressure threshold has been reached. Thus, the controller may power OFF the lift pump in response to the duration of the lift pump activation period expiring, and/or when a desired fuel rail pressure threshold has been reached. The desired fuel rail pressure threshold is a fuel rail pressure that is higher than the threshold pressure described at 508. In some examples, the desired fuel rail pressure threshold may be pre-set. However, in other examples, the desired fuel rail pressure may be determined based on engine operating conditions such as intake manifold pressure. Method 500 then returns.

Continuing to FIG. 6A, it shows a method 600 for determining a desired pressure profile (and therefore a desired electrical power profile) for the lift pump when powering the lift pump during the intermittent power second mode. Thus, method 600 may be included as a subroutine of method 500 and may be executed at 516 of method 500, described above with reference to FIG. 5. It is important to note that the method 600 is executed for open loop control of the lift pump. Thus, the method 600 describes a method for determining what the desired pressure profile should be when open loop operating the lift pump during the intermittent second mode. As such, adjusting the electrical power supplied to the lift pump is achieved by adjusting the desired pressure, since during open loop control, the power supplied to the lift pump is adjusted by the control based on the desired pressure and not based on outputs from the pressure sensors. In the description herein of FIG. 6A therefore, the electrical power profile and the desired pressure profile may be used interchangeably, since the desired pressure profile dictates what the electrical power profile will be.

Method 600 begins at 602 which comprises determining how much electrical power to supply to the lift pump initially, when powering on the lift pump. More specifically, the method 600 at 602 may comprise determining how much to step up the desired pressure. Thus, the method 600 at 602 may comprise determining the pressure and/or electrical power level of the intermediate second level described above at 524 of method 500 in FIG. 5. In some examples, the amount that the desired pressure is stepped up may be pre-set. The pre-set electrical power level (e.g., power, voltage, current, etc.) may be a power at which the pressure upstream of the check valve is maintained at, or just below the threshold pressure described above at 508 of FIG. 5. Thus, the electrical power of the lift pump may be maintained at a level sufficient to keep the fuel pressure upstream of the check valve at, or just below the minimum acceptable fuel rail pressure. In this way, the fuel rail pressure may be kept above the threshold. However, in other examples, the step increase in desired pressure may be determined based on current operating conditions. For example, the step increase in desired pressure may increase for one or more of increases in a predicted rate of decrease of the fuel rail pressure, increases in a predicted rate of fuel injection, etc.

Method 600 may then continue from 602 to 604 which comprises determining how long to maintain the electrical power provided to the lift pump at the intermediate second level and determining when to initiate a ramping increase in lift pump power. As described above in FIG. 5, the desired pressure may be maintained at the intermediate second level for a pre-set duration. The pre-set duration may be calculated based on the lift pump voltage supplied to the lift pump, the pressure downstream of the check valve, and predicted changes in the pressure downstream of the check valve. However, in other examples, the desired pressure may be maintained at the intermediate second level until the pressure upstream of the check valve reaches, or increases to within a threshold difference of the pressure downstream of the check valve.

Method 600 may then continue from 604 to 606 which comprises determining a step up in the desired pressure is desired prior to initiating the ramping increase in desired pressure. A step up in the desired pressure may be desired prior to initiating the ramping increase when a desired increase in fuel rail pressure is more immediate. Thus, the desired pressure may be stepped up from the intermediate second level to a higher third level prior to initiating the ramping to increase the responsiveness of the lift pump. If a step up from the intermediate second level to the third level is desired prior to the ramping, method 600 continues from 606 to 608 which comprises determining how much to step up the electrical power supplied to the lift pump before initiating the ramping increase. Thus, the method 600 at 608 may comprises determining at what pressure to set the third level (e.g., third level described above in 528 of method 500 in FIG. 5). In some examples, the amount that the desired pressure is stepped up at 608 may be pre-set. However, in other examples, the amount that the desired pressure is stepped up at 608 may be determined based on a current and/or predicted rate of decrease in the fuel rail pressure. For example, if while maintaining the desired pressure at the second level, fuel injection increases more than was anticipated, and consequently fuel rail pressure decreases more quickly than was anticipated when setting the second level at 602, then the third level may be increased to prevent the fuel rail pressure from decreasing below the threshold. Thus, the amount that the desired fuel rail pressure is stepped up from the second level to the third level may increase when the actual fuel rail pressure decreases more rapidly than was anticipated or predicted at for example, step 512 of method 500 in FIG. 5.

Method 600 may then continue to 610 from either 606 if the step up prior to ramping is not desired, or from 608, where the method 600 at 610 comprises determining the duration and rate of increase of the ramping. In some examples, the duration and/or rate of increase of the desired pressure may be pre-set. The duration over which the ramping is performed may be a pre-set duration (e.g., amount of time, number of engine cycles, etc.). However, in other examples, the duration may depend on one or more engine operating conditions, such as fuel rail pressure. For example, the controller may terminate the ramping increase and power off the lift pump in response to the fuel rail pressure increasing above a higher threshold, the higher threshold being a higher pressure than the pressure represented by the lower threshold which triggers powering on the lift pump as described above at 508 of method 500 in FIG. 5. In some examples, the higher threshold may be a pre-set threshold. However, in other examples, the higher threshold may be adjusted by the controller based on engine operating conditions, such as intake manifold pressure.

In some examples, the rate of increase of the ramping may be pre-set. However, in other examples, the rate of increase of the ramping may be adjusted based on engine operating conditions. The ramping rate of increase may be approximately the same as, or less than, a maximum rate of increase in manifold pressure, where the rate of change in manifold pressure may be expressed as a rate of change in pressure with respect to crank angle. However, in other examples, the rate at which the desired pressure is ramped up may be adjusted based on changes in the manifold pressure. For example, the rate at which the desired pressure is ramped up may increase for increases in manifold pressure. Thus, if the manifold pressure is increasing while the controller is ramping up the desired pressure, the controller may increase the rate of ramping to maintain the fuel rail pressure above the manifold pressure. Method 600 then returns.

Thus, a method may comprise powering a lift pump in a pre-defined manner when powering the lift pump during an intermittent power mode, where during the intermittent power mode the lift pump remains off, unless the fuel rail pressure will decrease below a lower threshold were the lift pump to not be powered on. The pre-defined manner in which the lift pump is to be powered during the activation period (period during which the lift pump is powered on during the intermittent second mode) may be determined prior to powering on the lift pump. For example, the pre-defined manner may comprise a scheduled electrical power profile. The controller then delivers electrical power to the lift pump during the activation period in accordance with the scheduled electrical power profile. In some examples, the electrical power profile may be pre-set. However, in other examples, the controller may determine the electrical power profile based on engine operating conditions that exist when generating the electrical power profile. Further, in some examples, the controller may adjust the electrical power profile while powering the lift pump during the activation period in the intermittent second mode based on changes in engine operating conditions.

Figure 6B:
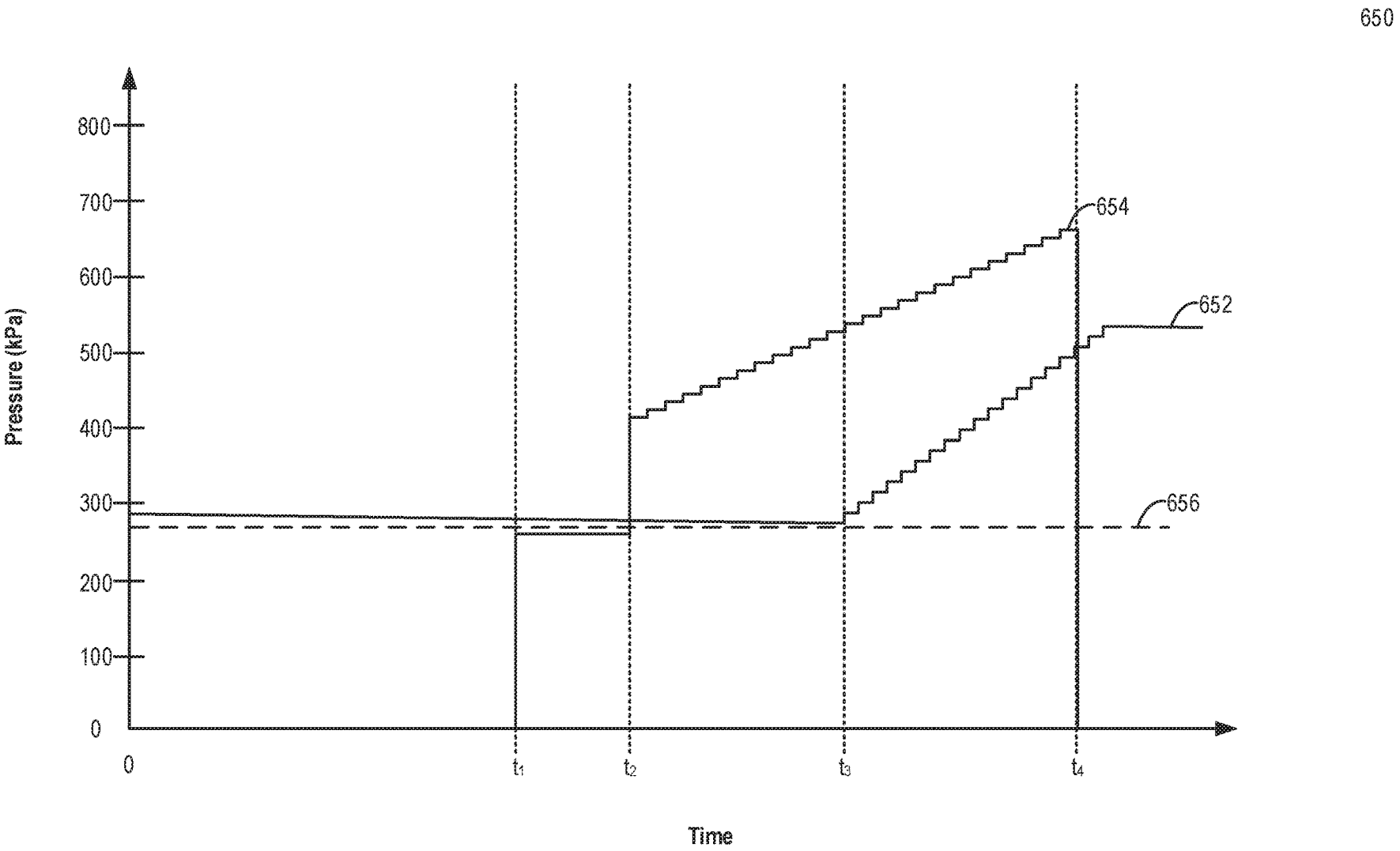
FIG. 6B shows a graph depicting example control of the lift pump during the intermittent second mode when powering the lift pump, in accordance with an embodiment of the present disclosure.

Continuing to FIG. 6B, it shows an example desired pressure profile which may be generated by executing the method 600 described above in FIG. 6A. Specifically, FIG. 6B shows a graph 650 depicting example adjustments to the desired pressure (e.g., set point) for the lift pump when open loop controlling the lift pump during the intermittent second power mode. Specifically, graph 650 shows a first plot 652 depicting changes in fuel rail pressure, and a second plot 654 depicting changes in the desired pressure. Time is shown along the x-axis, and pressure is shown along the y-axis. Example pressures are shown in units of kPa, however other pressure levels are possible.

Before $t_1$, the lift pump may be OFF, and thus the desired pressure is set to 0 (plot 654). At $t_1$, it may be determined that it is desired to power on the lift pump. In particular, it may be determined at $t_1$ that were the lift pump to be powered on at the current time, the minimum pressure of the fuel rail would be equal to, or within a threshold difference above a lower first threshold pressure 656. Thus, the controller may power on the lift pump at $t_1$ to prevent the fuel rail pressure from decreasing below the first threshold pressure 656. The first threshold pressure 656 may be the same as the minimum threshold pressure discussed above with reference to 508 of method 500 in FIG. 5.

As described above at 602 and 604 of FIG. 6A, the controller may determine how much and/or for how long to step up the desired pressure at $t_1$. In the example, of FIG. 6B, the desired pressure may be stepped up at $t_1$ to just below the minimum pressure that the fuel rail is expected to reach before the lift pump begins adding pressure to the fuel rail. However, in other examples, the pressure may be stepped up to just below the current fuel rail pressure at $t_1$. Thus, the lift pump may be powered sufficiently to bring the fuel pressure upstream of the check valve to approximately the minimum threshold pressure, such that when the fuel rail pressure reaches the minimum threshold pressure, the lift pump can immediately begin adding pressure to the fuel rail.

The desired pressure may be held at the second level between $t_1$ and $t_2$, and then at $t_2$, in response to the pressure upstream of the check valve substantially reaching the pressure downstream of the check valve, the controller may step up the desired pressure from the second level to the third level. The amount that the controller steps up the desired pressure at $t_2$ may be determined in the manner described at 608 of FIG. 6. By stepping up the desired pressure at $t_2$ prior to initiating the ramping increase, the responsiveness of the lift pump may be increased.

Between $t_2$ and $t_3$ the fuel rail pressure may continue to decrease. The fuel rail pressure may continue to decrease for one or more of the following reasons: the pressure upstream of the check valve is still less than the pressure downstream of the check valve, or if the pressure upstream of the check valve has reached the pressure downstream of the check valve, there may be a delay in fuel delivery to the fuel rail from the lift pump, and/or the fuel injection rate may still exceed the rate at which fuel is delivered to the fuel rail. The rate of increase in the desired fuel rail pressure between $t_2$ and $t_4$ may be determined in the manner described above at 610 of FIG. 6. At $t_3$, the fuel rail pressure may reach the minimum fuel rail pressure, and may begin increasing. Thus, the lift pump may begin adding pressure to the fuel rail at $t_3$.

The ramping increase in desired fuel rail pressure between $t_2$ and $t_4$ may be a pre-set duration. Thus, after the duration has expired at $t_4$, the lift pump may be powered off, and the desired pressure may be returned to 0. However, in other examples, the lift pump may be powered OFF at $t_4$ in response to the fuel rail pressure increasing to a higher second threshold.

Figure 7:
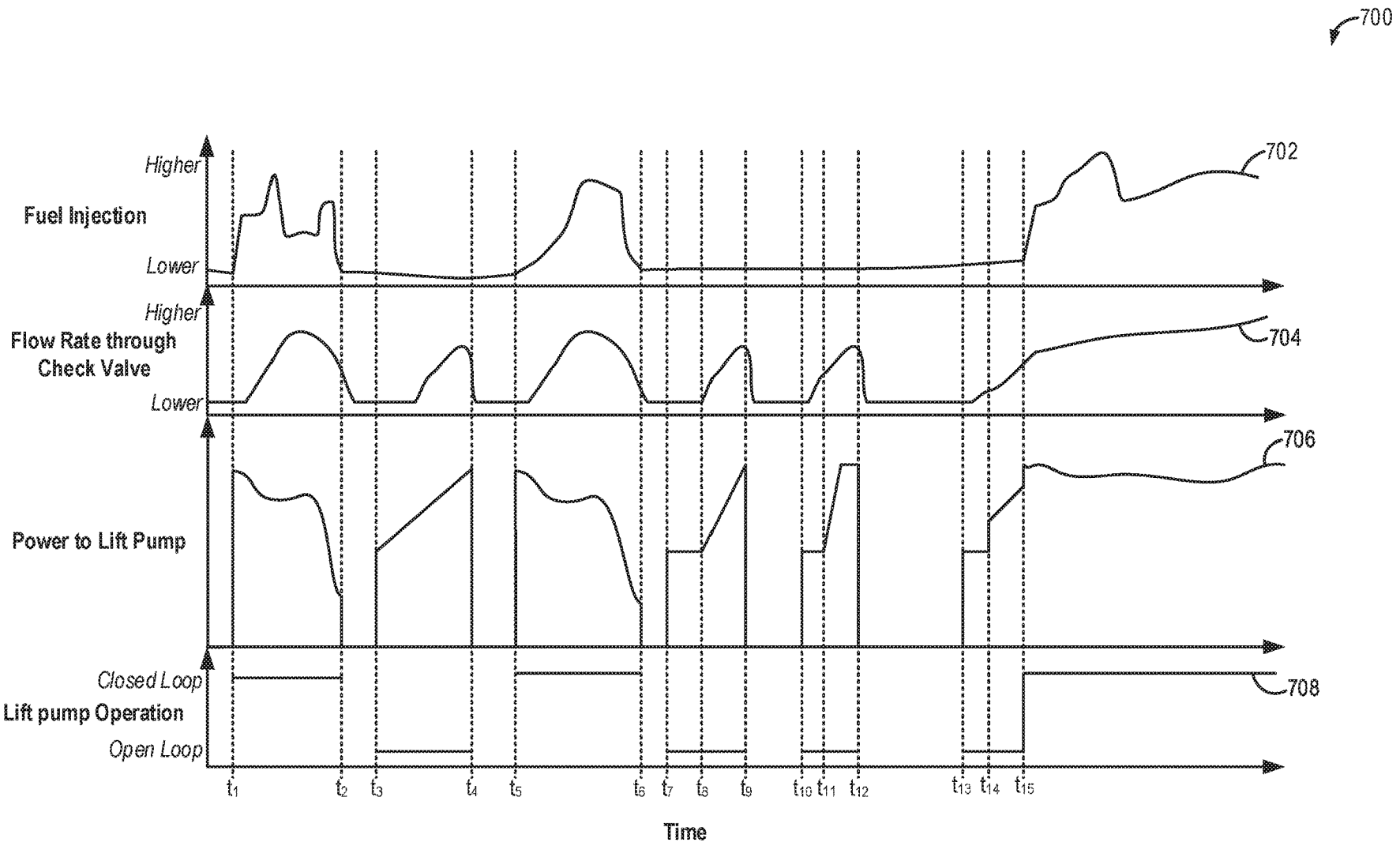
FIG. 7 shows a graph depicting example fuel lift pump operation under varying engine operating conditions, in accordance with an embodiment of the present disclosure.

Turning now to FIG. 7, it shows a graph 700 depicting example operation of a lift pump (e.g., lift pump 212 shown in FIG. 2) under varying engine operating conditions. Power supplied to the lift pump, and therefore amount of fuel flowing out of the pump, may be adjusted by an engine controller (e.g., controller 222 shown in FIG. 2). When fuel injection from one or more fuel injectors (e.g., injectors 252 and 262 shown in FIG. 2) is greater than a threshold, the lift pump may be feedback controlled by the controller based on outputs from a pressure sensor (e.g., pressure sensors 248 and 258 shown in FIG. 2) positioned in a fuel rail (e.g., fuel rail 260 described above in FIG. 2). However, when fuel injection is less than a threshold, the controller may power off the lift pump, and may only power on the lift pump for brief durations to maintain the fuel rail pressure above a threshold.

Graph 700 shows changes in the fuel injection mass flow rate at plot 702. Changes in the flow rate through a check valve (e.g., check valve 213 described above in FIG. 2) positioned between the lift pump and the fuel rail is shown at plot 704. The flow rate through the check valve may be inferred based on one or more of the injection flow rate, a rate of change in pressure in the fuel line, and a temperature of the fuel. In further examples, the flow rate through the check valve may be determined based on a pressure upstream of the check valve as estimated via a first pressure sensor positioned upstream of the check valve (e.g., pressure sensor 231 described above in FIG. 2), and a pressure downstream of the check valve as estimated via a second pressure sensor positioned downstream of the check valve (e.g., pressure sensor 258 described above in FIG. 2). Thus, flow through the check valve may be zero when the pressure downstream of the check valve is greater than the pressure upstream of the check valve. However, when the pressure upstream of the check valve exceeds the pressure downstream of the check valve, fuel may begin flowing through the check valve towards the fuel rail. Thus, the flow through the check valve may be estimated based on a pressure difference across the check valve, where the flow rate through the check valve may increase with increases differences in pressure across the check valve.

The check valve may be positioned near an outlet of the lift pump, and may restrict and/or prevent flow back towards the lift pump. An amount of electrical power (e.g., voltage and/or current) supplied to the lift pump by the controller is shown at plot 706. Operation of the lift pump in either open loop or closed-loop control is shown at plot 708. During closed loop control of the lift pump, power to the lift pump is adjusted based on a difference between a desired fuel rail pressure and the actual measured fuel rail pressure. Thus, the power to the lift pump may be significantly reduced and/or brought to zero when the measured fuel rail pressure is greater than the desired fuel rail pressure. Thus, when the lift pump is off or at a sufficiently low voltage such that it is not adding pressure to the fuel rail (the lift pump could be powered on, but only to a level where the pressure upstream of the check valve is kept below the fuel rail pressure) fuel may not be flowing through the check valve. Conversely, when the measured fuel rail pressure is less than the desired fuel rail pressure, the lift pump may be powered on to increase the actual fuel rail pressure to the desired fuel rail pressure fuel, and thus fuel may be flowing through the check valve (assuming no delays in pump spin-up). Thus by powering the lift pump such that the pressure upstream of the check valve is maintained at or just below the minimum fuel rail pressure, the responsiveness of the pump may be improved. That is, the pump may begin adding pressure to the fuel rail more quickly by keeping the pressure upstream of the check valve to or just below the minimum fuel rail pressure. Thus by "priming" the fuel line upstream of the check valve, the pump may begin adding pressure to the fuel rail as soon as the fuel rail reaches the pressure upstream of the check valve.

Starting before $t_1$, fuel injection may be less than a threshold (plot 702), and the lift pump may be powered OFF. Fuel may therefore not be flowing through the check valve. At $t_1$, fuel injection may increase above the threshold, and the lift pump may be powered on in closed-loop feedback control. Thus, the controller may adjust an amount of power supplied to the lift pump based on outputs from the fuel rail pressure sensor between $t_1$ and $t_2$.

Then at $t_2$, the fuel injection rate may decrease below a lower threshold (e.g., threshold 656 described above in FIG. 6B) and the lift pump may be powered OFF. Thus, the controller may switch to operating the lift pump in the intermittent second mode at $t_2$. At $t_3$, it may be predicted that the fuel rail pressure will decrease below the threshold unless the lift pump is powered on at the current time, and thus, the lift pump is powered on at $t_3$. Specifically, the lift pump power may be stepped up from a lower first level (e.g., 0V) to an intermediate second level. The lift pump power may then be ramped up between $t_3$ and $t_4$. At $t_4$, the lift pump may be powered OFF, and may remain OFF until $t_5$. Fuel injection remains below the threshold between $t_2$ and $t_5$. However, at $t_5$ fuel injection increases above the threshold, and thus, the lift pump is powered ON at $t_5$. Thus, at $t_5$ the controller switches to operating the lift pump in the continuous power first mode. The controller adjusts the amount of power supplied to the lift pump between $t_5$ and $t_6$ based on outputs from the fuel rail pressure sensor.

At $t_6$, the fuel injection rate decreases below the threshold, and the lift pump is switched to the intermittent second mode of operation and is powered OFF. At $t_7$, it is determined that the fuel rail pressure will decrease below the threshold unless the lift pump is powered on at the current time, and thus, the lift pump is powered on at $t_7$. Specifically, the lift pump power may be stepped up from the lower first level (e.g., 0V) to the intermediate second level. The lift pump power may be held at the intermediate second level between $t_7$ and $t_5$, while the pressure upstream of the check valve remains below the pressure downstream of the check valve. At $t_5$, the pressure upstream of the check valve may reach the pressure downstream of the check valve, and fuel may begin flowing through the check valve toward the fuel rail. The controller may ramp up (e.g., monotonically increase) power to the lift pump between $t_5$ and $t_9$ and add pressure to the fuel rail. At $t_9$, the lift pump may be powered OFF. Fuel injection rates remain below the threshold between $t_9$ and $t_{10}$, and thus, the lift pump remains OFF. However, fuel rail pressure may continue to decrease, and at $t_{10}$, it is determined that the fuel rail pressure will decrease below the threshold unless the lift pump is powered on at the current time, and thus, the lift pump is powered on at $t_{10}$. Specifically, the lift pump power may be stepped up from the lower first level (e.g., 0V) to the intermediate second level. The lift pump power is held at the intermediate second level between $t_{10}$ and $t_{11}$, and then in response to fuel beginning to flow through the check valve, the controller may ramp up the electrical power supplied to the lift pump between $t_{11}$ and $t_{12}$. However, the controller may ramp up the electrical power supplied to the lift pump up to a maximum lift pump power level, and then hold the lift pump power at the maximum level for a duration. Then at $t_{12}$, the lift pump is powered OFF.

Fuel injection rates remain below the threshold between $t_{12}$ and $t_{13}$, and thus, the lift pump remains OFF. However, fuel rail pressure may continue to decrease, and at $t_{13}$, it is determined that the fuel rail pressure will decrease below the threshold unless the lift pump is powered on at the current time, and thus, the lift pump is powered on at $t_{13}$. Specifically, the lift pump power may be stepped up from the lower first level (e.g., 0V) to the intermediate second level. The lift pump power is held at the intermediate second level between $t_{13}$ and $t_{14}$, and then in response to fuel beginning to flow through the check valve, the controller may ramp up the electrical power supplied to the lift pump between $t_{14}$ and $t_{15}$. However, before the controller can reach the maximum voltage to be supplied to the lift pump during the ramping, the fuel injection rate may increase above the threshold at $t_{15}$. Thus, the controller may exit the intermittent second mode, and may switch to operating the lift pump in the continuous power first mode at $t_{15}$ in response to the fuel injection rates increasing above the threshold. After $t_{15}$ the fuel injection rates may remain above the threshold, and the controller may continue to closed-loop control lift pump power in the continuous power first mode.

In one representation a method comprises maintaining a lift pump off that supplies fuel to a fuel rail, assuming that the lift pump is maintained off, predicting when a fuel rail pressure will decrease below a threshold based on fuel injection rates, and powering on the lift pump before the fuel rail pressure decreases below the threshold such that actual fuel rail pressures do not decrease below the threshold. In a first example of the method, the method further comprises estimating what a minimum future fuel rail pressure would be were the lift pump to be powered on at a current instance based on one or more of fuel line stiffness, fuel injection rates, and a lift pump spin-up period, where the minimum future fuel rail pressure is a fuel rail pressure at which the lift pump would begin to add pressure to the fuel rail. A second example of the method optionally includes the first example and further includes, wherein the powering on the lift pump is initiated in response to the minimum future fuel rail pressure decreasing to within a threshold difference of the threshold, such that future fuel rail pressures do not decrease below the threshold. A third example of the method optionally includes one or more of the first and second examples, and further includes that the lift pump spin-up period is estimated based on one or more of a predicted fuel rail pressure profile and an amount of electrical power to be supplied to the lift pump when powering on the lift pump. A fourth example of the method optionally includes one or more of the first, second, and third examples, and further includes that the minimum future fuel rail pressure decreases for increases in one or more of the fuel line stiffness, fuel injection rates, and lift pump spin-up period. A fifth example of the method optionally includes one or more of the first, second, third, and fourth examples, and further includes maintaining a voltage supplied to the lift pump at a lower first level prior to the fuel rail pressure reaching the minimum fuel rail pressure, and in response to the fuel rail pressure reaching the minimum fuel rail pressure, increasing the voltage supplied to the lift pump. A sixth example of the method optionally includes one or more of the first, second, third, fourth, and fifth examples, and further includes that the increasing the voltage supplied to the lift pump comprises first stepping up the voltage from the lower first level to an intermediate second level, and then ramping up the voltage from the intermediate second level to a higher third level over a duration. A seventh example of the method optionally includes one or more of the first, second, third, fourth, fifth, and sixth examples, and further includes that the increasing the voltage supplied to the lift pump comprises ramping up the voltage from the lower first level to a higher second level over a duration. An eighth example of the method optionally includes one or more of the first, second, third, fourth, fifth, sixth, and seventh examples, and further includes that the powering on the lift pump comprises electrically powering the lift pump for a duration, and where the method further comprises powering off the lift pump after the duration. A ninth example of the method optionally includes one or more of the first, second, third, fourth, fifth, sixth, seventh, and eighth examples, and further includes that the powering on the lift pump comprises electrically powering the lift pump until the fuel rail pressure increases to a higher second threshold, and where the method further comprises powering off the lift pump in response to the fuel rail pressure increasing above the higher second threshold.

In another representation, a method comprises predicting when a fuel rail pressure will decrease below a threshold, calculating a desired instance to power on a lift pump based on a lift pump delay period, where the desired instance precedes when the fuel rail pressure is predicted to decrease below the threshold, stepping up a voltage supplied to the lift pump from zero to a first level at the desired instance, and ramping up the voltage supplied to the lift pump from the first level after the desired instance. In a first example of the method, the predicting when the fuel rail pressure will decrease below the threshold is determined based on one or more of fuel line stiffness and fuel injection rates. A second example of the method optionally includes the first example and further includes maintaining the voltage supplied to the lift pump at the first level for a duration before ramping up the voltage. A third example of the method optionally includes one or more of the first and second examples, and further includes that the lift pump delay period comprises a duration that passes from the instance the lift pump is powered on to when the lift pump begins adding pressure to the fuel rail. A fourth example of the method optionally includes one or more of the first, second, and third examples, and further includes that the lift pump delay period is determined by maintaining the fuel rail pressure at the threshold while powering on the lift pump, and recording how long it takes for the lift pump to begin adding pressure to the fuel rail. A fifth example of the method optionally includes one or more of the first, second, third, and fourth examples, and further includes that the calculating the desired instance to power on the lift pump is additionally based on one or more of fuel compressibility and fuel injection rates. A sixth example of the method optionally includes one or more of the first, second, third, fourth, and fifth examples, and further includes detecting a faulty check valve when fuel compressibility increases by more than a threshold rate.

In another representation, a system comprises a lift pump, a fuel line coupled to the lift pump and comprising a fuel rail, the fuel rail including one or more fuel injectors, the fuel line delivering fuel from the lift pump to the fuel injectors, a check valve positioned in the fuel line between the lift pump and the fuel rail for maintaining fuel pressure downstream of the check valve, between the check valve and the fuel injectors, and a controller in electrical communication with the lift pump, the controller including computer readable instructions stored in non-transitory memory for: while the lift pump is off, predicting a decay profile for the fuel pressure downstream of the check valve, determining an instance to power on the lift pump based on the decay profile and a delay period of the lift pump such that the fuel pressure downstream of the check valve does not decrease below a threshold, and powering on the lift pump at the determined instance, before the fuel pressure downstream of the check valve reaches the threshold. In a first example of the system, the fuel rail comprises a port fuel injection rail, and where the fuel injectors inject fuel into an intake manifold, upstream of one or more engine cylinders. A second example of the system optionally includes the first example and further includes, that the controller further includes instruction stored in non-transitory memory for powering the lift pump at a voltage sufficient to increase fuel line pressure upstream of the check valve to the threshold, and then increasing the voltage supplied to the lift pump as desired in response to the fuel rail pressure decreasing to within a threshold difference above the threshold.

In yet another representation, a method comprises predicting a pressure profile of a fuel rail over a future horizon based on one or more of fuel line stiffness and fuel injection rates, calculating a fuel pump delay based on an initial lift pump voltage to be supplied to a lift pump when powering on the lift pump, determining a desired time to power on the lift pump based on the fuel pump delay and the pressure profile such that fuel pressure in the fuel rail does not decrease below a threshold over the future horizon, and supplying the initial lift pump voltage to the lift pump at the desired time, where the initial lift pump voltage is a voltage less than a maximum voltage of the lift pump.

In yet another representation, a method comprises calculating a desired time to power on a lift pump based on one or more of fuel line stiffness, a fuel volume rate exiting a fuel rail, and a lift pump delay period, stepping up a voltage supplied to the lift pump to a first level at the desired time, and ramping up the voltage supplied to the lift pump from the first level after the desired time.

In this way, a technical effect of reducing fuel rail pressure undershoots is achieved by powering on a lift pump before the fuel rail pressure decreases to low enough levels that would lead to insufficient fuel delivery. Thus, by predicting fuel rail pressure decay over a future horizon and then powering on the lift pump before the fuel rail pressure reaches undesirably low levels, fuel rail pressure may be maintained to desirable levels while increasing energy efficiency. Thus, by only powering on the lift pump when the fuel rail pressure is expected to decrease below a threshold, electrical power to the lift pump may be reduced, saving fuel costs. At the same time, the fuel savings may be achieved without sacrificing engine performance, by ensuring that fuel rail pressures are kept sufficiently high by powering on the lift pump before the fuel rail pressures reach undesirable levels.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

selecting from each of a continuous first mode where a lift pump of a fuel system arranged upstream of a higher pressure pump is maintained on and electrical power is supplied to the lift pump at a level based on fuel rail pressure and an intermittent second mode where the lift pump is powered off and then periodically powered on to maintain the fuel rail pressure above a threshold, wherein the selecting is based on an efficiency of the lift pump; and operating the lift pump in the selected mode;

where operating the lift pump in the selected mode includes, responsive to determining the intermittent second mode is more efficient than the continuous first mode, intermittently powering the lift pump by stepping up a voltage supplied to the lift pump from zero to a first level when powering on the lift pump from off, and then ramping up the voltage supplied to the lift pump above the first level.

2. The method of claim 1, where, responsive to selecting the intermittent second mode, operating the lift pump in the intermittent second mode includes maintaining the electrical power to the lift pump off while the fuel rail pressure remains above the threshold and only powering on the lift pump when the fuel rail pressure is expected to decrease below the threshold.

3. The method of claim 2, where powering on the lift pump in the intermittent second mode comprises first increasing an amount of the electrical power supplied to the lift pump from zero to a lower level, the lower level being a voltage less than a maximum voltage limit of the lift pump, and then monotonically increasing the electrical power supplied to the lift pump to a higher level.

4. The method of claim 1, where the selecting includes selecting the intermittent second mode in response to engine speed being less than a speed threshold.

5. The method of claim 1, where the efficiency of the lift pump is a predicted future lift pump efficiency.

6. The method of claim 1, where the selecting includes selecting the intermittent second mode in response a driver torque demand being less than a torque threshold.

7. The method of claim 1, where the selecting includes selecting the intermittent second mode in response to intake mass airflow being less than an airflow threshold.

8. The method of claim 1, where the selecting includes selecting the intermittent second mode in response to each of a commanded fuel injection amount, an intake mass airflow, an engine speed, a driver demanded torque, and a fuel flow out of the lift pump each decreasing below a respective threshold.

9. The method of claim 1, where the selecting includes determining whether it is more energy efficient to operate the lift pump in the continuous first mode or the intermittent second mode based on an engine operating condition, where the engine operating condition includes a current fuel flow rate out of the lift pump, and selecting the intermittent second mode when the current fuel flow rate is below a threshold fuel flow rate.

10. The method of claim 9, where the selecting includes selecting the continuous first mode when the current fuel flow rate is above the threshold fuel flow rate.

11. The method of claim 10, further comprising adjusting the threshold fuel flow rate during engine operation.

12. A method, comprising:

determining, based on a fuel flow rate out of a lift pump of a fuel system arranged upstream of a higher pressure pump, whether it is more efficient to operate the lift pump in a continuous mode where power to the lift pump is supplied continuously at a level that is based on fuel rail pressure or in an intermittent mode where power to the lift pump is supplied intermittently; and operating the lift pump in the mode that is determined to be most efficient;

where operating the lift pump in the mode includes, responsive to determining the intermittent mode is more efficient than the continuous mode, intermittently powering the lift pump by stepping up a voltage supplied to the lift pump from zero to a first level when powering on the lift pump from off, and then ramping up the voltage supplied to the lift pump above the first level.

13. The method of claim 12, further comprising determining that the continuous mode is most efficient and, in response to determining that the continuous mode is most efficient, operating the lift pump in the continuous mode, where operating the lift pump in the continuous mode includes continuously supplying electrical power to the lift pump at a duty-cycled voltage, where the duty-cycled voltage is based on the fuel rail pressure.

14. A method, comprising:

determining, based on a fuel flow rate out of a lift pump of a fuel system, whether it is more efficient to operate the lift pump in a continuous mode where power to the lift pump is supplied continuously at a level that is based on fuel rail pressure or in an intermittent mode where power to the lift pump is supplied intermittently, where intermittently powering the lift pump comprises stepping up a voltage supplied to the lift pump from zero to a first level when powering on the lift pump from off, and then ramping up the voltage above the first level;

operating the lift pump in the mode that is determined to be most efficient; and determining that the intermittent mode is most efficient and, in response to determining that the intermittent mode is most efficient, operating the lift pump in the intermittent mode, wherein operating the lift pump in the intermittent mode includes only powering on the lift pump from off in response to a prediction that the fuel rail pressure will decrease below a pre-set threshold over a future horizon based on fuel injection rates and powering on the lift pump before reaching a predicted time that the fuel rail pressure will decrease below the pre-set threshold.

15. The method of claim 12, further comprising determining that it is more efficient to operate the lift pump in the intermittent mode in response to the fuel flow rate being less than a threshold, where the fuel flow rate is determined based on current engine operating conditions.

16. The method of claim 15, where the current engine operating conditions include a commanded fuel injection amount, engine speed, and engine load being less than a respective threshold.

17. The method of claim 15, further comprising determining that it is more efficient to operate the lift pump in the continuous mode in response to the fuel flow rate being greater than the threshold.

18. The method of claim 12, further comprising predicting a plurality of future lift pump efficiencies based on a plurality of future engine operating conditions and determining which of the continuous mode and intermittent mode is most efficient at the plurality of future engine operating conditions and only switching operating the lift pump from the continuous mode to the intermittent mode or the intermittent mode to the continuous mode in response to predicting that the determined most efficient mode will be more efficient for a duration.

* * * * *